US011763765B1

(12) United States Patent
Yang et al.

(10) Patent No.: US 11,763,765 B1
(45) Date of Patent: Sep. 19, 2023

(54) LIQUID CRYSTAL DISPLAY ASSEMBLY AND ELECTRONIC DEVICE

(71) Applicant: HKC CORPORATION LIMITED, Shenzhen (CN)

(72) Inventors: Keming Yang, Guangdong (CN); Yizhen Xu, Guangdong (CN); Liu He, Guangdong (CN); Feng Jiang, Guangdong (CN); Qiang Leng, Guangdong (CN); Junlin Wang, Guangdong (CN); Rongrong Li, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/091,692

(22) Filed: Dec. 30, 2022

(30) Foreign Application Priority Data

Jul. 26, 2022 (CN) ..... 202210881095.7

(51) Int. Cl.
*G09G 3/36* (2006.01)

(52) U.S. Cl.
CPC ... *G09G 3/3607* (2013.01); *G09G 2300/0452* (2013.01); *G09G 2320/0233* (2013.01);
(Continued)

(58) Field of Classification Search
None
See application file for complete search history.

(56) References Cited

U.S. PATENT DOCUMENTS

2006/0221047 A1 10/2006 Tanizoe et al.
2007/0126975 A1 6/2007 Choi et al.
(Continued)

FOREIGN PATENT DOCUMENTS

CN 103278945 A 9/2013
CN 103489420 A 1/2014
(Continued)

OTHER PUBLICATIONS

First Office Action issued in corresponding CN Application No. CN202210881095.7, dated Sep. 5, 2022, pp. 1-5, Beijing, China.
(Continued)

*Primary Examiner* — Parul H Gupta
(74) *Attorney, Agent, or Firm* — HAUPTMAN HAM, LLP

(57) ABSTRACT

A Liquid Crystal Display (LCD) assembly and an electronic device is provided in the disclosure. The LCD assembly includes a liquid crystal panel, a resistance detection unit, and a color-temperature-compensation unit. The liquid crystal panel has a first detection point in a first region and a second detection point in a second region. The resistance detection unit is configured to obtain a first resistance value by detecting a resistance value at the first detection point and obtain a second resistance value by detecting a resistance value at the second detection point, and further configured to obtain a resistance difference by calculating a difference between the second resistance value and the first resistance value. The color-temperature-compensation unit is configured to receive the resistance difference, and determine whether Mura appears in a region corresponding to the first detection point in the first region according to the resistance difference.

15 Claims, 12 Drawing Sheets

(52) U.S. Cl.
CPC ..... *G09G 2320/0666* (2013.01); *G09G 2320/0693* (2013.01); *G09G 2330/12* (2013.01)

(56) References Cited

U.S. PATENT DOCUMENTS

| | | | | |
|---|---|---|---|---|
| 2007/0146619 | A1 | 6/2007 | Shyu | |
| 2009/0140972 | A1 | 6/2009 | Park et al. | |
| 2011/0273906 | A1 | 11/2011 | Nichol et al. | |
| 2013/0083457 | A1 | 4/2013 | Wurzel et al. | |
| 2016/0077553 | A1 | 3/2016 | Hyun | |
| 2016/0139445 | A1 | 5/2016 | Zhu et al. | |
| 2016/0140917 | A1 | 5/2016 | Hyung et al. | |
| 2016/0286211 | A1 | 9/2016 | Zhang et al. | |
| 2017/0153510 | A1 | 6/2017 | Stoot et al. | |
| 2018/0033380 | A1 | 2/2018 | An | |
| 2018/0151135 | A1 | 5/2018 | Kim et al. | |
| 2018/0158423 | A1 | 6/2018 | Kim et al. | |
| 2018/0166018 | A1* | 6/2018 | Yang | G09G 3/3266 |
| 2018/0233096 | A1 | 8/2018 | Zhao | |
| 2019/0139470 | A1 | 5/2019 | Yoo et al. | |
| 2019/0174595 | A1* | 6/2019 | Hsiang | H01L 25/167 |
| 2019/0279583 | A1 | 9/2019 | Shang et al. | |
| 2020/0227006 | A1 | 7/2020 | Yao et al. | |
| 2020/0235185 | A1 | 7/2020 | Nie | |
| 2021/0097943 | A1 | 4/2021 | Wyatt | |

FOREIGN PATENT DOCUMENTS

| | | | |
|---|---|---|---|
| CN | 103676239 | A | 3/2014 |
| CN | 106409231 | A | 2/2017 |
| CN | 108121102 | A | 6/2018 |
| CN | 109920363 | A | 6/2019 |
| CN | 110447061 | A | 11/2019 |
| CN | 112951172 | A | 6/2021 |
| CN | 113889023 | A | 1/2022 |
| CN | 114530481 | A | 5/2022 |
| JP | 2009157190 | A | 7/2009 |
| JP | 2013054520 | A | 3/2013 |
| JP | 2021056175 | A | 4/2021 |
| WO | 2022021423 | A1 | 2/2022 |

OTHER PUBLICATIONS

Jiang He:"Thermal performance of LED Filament in Flip-Chip Packaging Manufactured for Different Correlated Color Temperature" <<Applied Sciences>>; Dec. 31, 2021 (Dec. 31, 2021).

Liu Xiaowei, et al:"Analysis and improvement of a larger size TFT-LCD block mura", <<Chinese Journal of Liquid Crystals and Displays>>, No. 11, Nov. 15, 2016 (Nov. 15, 2016).

D. Mutharasu:"Analysis of ZnO Thin Film as Thermal Interface Material for High Power Light Emitting Diode Application", <<Journal of Electronic Packaging>>, Dec. 31, 2016 (Dec. 31, 2016).

* cited by examiner

LIQUID CRYSTAL DISPLAY ASSEMBLY AND ELECTRONIC DEVICE

CROSS-REFERENCE TO RELATED APPLICATIONS

This application claims priority under 35 U.S.C. § 119(a) to Chinese Patent Application No. 202210881095.7, filed Jul. 26, 2022, the entire disclosure of which is incorporated herein by reference.

TECHNICAL FIELD

This disclosure relates to the technical field of display devices, and in particular, to a Liquid Crystal Display (LCD) assembly and an electronic device.

BACKGROUND

Liquid crystal panels are prone to gravity Mura due to process fluctuations during mass production in factors such as array film thickness, RGB film thickness, polyimide (PI) film thickness, and pillar spacer (PS) height, which may cause a poor quality of the liquid crystal panel.

SUMMARY

In a first aspect, an LCD assembly is provided in embodiments of the disclosure. The LCD assembly includes a liquid crystal panel. The liquid crystal panel has a first region and a second region. The first region is located at least one of a top portion or a bottom portion of the liquid crystal panel. The second region is closer to a center of the liquid crystal panel than the first region. The liquid crystal panel has a first detection point in the first region and a second detection point in the second region. The LCD assembly further includes a resistance detection unit and a color-temperature-compensation unit. The resistance detection unit is configured to obtain a first resistance value by detecting a resistance value at the first detection point and obtain a second resistance value by detecting a resistance value at the second detection point, and further configured to obtain a resistance difference by calculating a difference between the second resistance value and the first resistance value. The color-temperature-compensation unit is electrically connected to the resistance detection unit, configured to receive the resistance difference, determine whether Mura appears in a region corresponding to the first detection point in the first region according to the resistance difference, and perform color-temperature compensation on pixels in the region corresponding to the first detection point according to the resistance difference when Mura appears in the region corresponding to the first detection point.

In an embodiment, the liquid crystal panel has multiple first detection points in the first region and one second detection point in the second region. The resistance detection unit is configured to obtain multiple first resistance values by detecting resistance values at the multiple first detection points in a first preset sequence, and further configured to obtain multiple resistance differences by calculating a difference between the second resistance value and each of the multiple first resistance values. The color-temperature-compensation unit is configured to receive the multiple resistance differences, determine whether Mura appears in a region corresponding to each of the multiple first detection points in the first region according to the multiple resistance differences, and perform color-temperature compensation on pixels in each region where Mura appears according to the multiple resistance differences.

In an embodiment, the first region includes multiple sub-regions, where each of the multiple sub-regions includes multiple first detection points, the second region includes multiple second detection points, and each of the multiple second detection points corresponds to one of the multiple sub-regions. The resistance detection unit is configured to obtain multiple first resistance values by detecting resistance values at the multiple first detection points in a second preset sequence. The resistance detection unit is configured to obtain multiple second resistance values by detecting resistance values at the multiple second detection points in a third preset sequence, and obtain multiple sub-resistance differences by calculating a difference between each second resistance value and each of the first sub-resistance values obtained by detecting resistance values at the first detection points in a corresponding sub-region. The color-temperature-compensation unit is configured to receive the multiple sub-resistance differences, determine whether Mura appears in a region corresponding to each of the multiple first detection points in the first region according to the multiple sub-resistance differences, and perform color-temperature compensation on pixels in each region where Mura appears according to the multiple sub-resistance differences.

In an embodiment, a distance between the second detection point and a sub-region corresponding to the second detection point is smaller than a distance between the second detection point and each of other sub-regions.

In an embodiment, the resistance detection unit includes a timing setting subunit, a resistance detection subunit, and a calculation subunit. The timing setting subunit is configured to set a sequence of detecting the resistance values at the multiple first detection points, and further configured to set a sequence of detecting resistance values at multiple second detection points when the second region has the multiple second detection points. The resistance detection subunit is electrically connected to the timing setting subunit, configured to detect the resistance values at the multiple first detection points in the sequence set by the timing setting subunit, and further configured to detect the resistance values at the multiple second detection points in the sequence set by the timing setting subunit when the second region has the multiple second detection points. The calculation subunit is electrically connected to the resistance detection subunit, configured to receive the first resistance value and the second resistance value, and obtain the resistance difference by calculating the difference between the first resistance value and the second resistance value.

In an embodiment, the LCD assembly further includes a detection unit. The detection unit is configured to perform, after the color-temperature-compensation unit performs color-temperature compensation on a region where Mura appears in the first region, color-temperature detection on the region subject to the color-temperature compensation in the first region to obtain a color-temperature detection result, and determine whether the color-temperature compensation on the region subject to the color-temperature compensation satisfies a first preset standard according to the color-temperature detection result.

In an embodiment, the LCD assembly further includes a storage unit. The storage unit is configured to store multiple color-temperature compensation values satisfying a second preset standard and resistance differences each corresponding to one of the multiple color-temperature compensation values. The color-temperature-compensation unit is configured to compare a current resistance difference with the resistance differences in the storage unit, and to perform, when the current resistance difference matches one of the resistance differences in the storage unit, color-temperature compensation on the pixels in the region corresponding to the first detection point by using a color-temperature compensation value corresponding to the one of the resistance differences in the storage unit that matches the current resistance difference.

In an embodiment, the color-temperature-compensation unit is configured to perform, with a same compensation value, color-temperature compensation on all pixels in a region with the first detection point as a center.

In an embodiment, the pixels comprise a blue sub-pixel, a green sub-pixel, and a red sub-pixel, the color-temperature-compensation unit being configured to perform the color-temperature compensation on the pixels in the region corresponding to the first detection point according to the resistance difference includes at least one of:

the color-temperature-compensation unit being configured to increase a brightness of the blue sub-pixel in a region corresponding to the first detection point where Mura appears, and maintain a brightness of the green sub-pixel and a brightness of the red sub-pixel in the region corresponding to the first detection point where Mura appears;

the color-temperature-compensation unit being configured to reduce the brightness of the green sub-pixel and the brightness of the red sub-pixel in the region corresponding to the first detection point where Mura appears, and maintain the brightness of the blue sub-pixel in the region corresponding to the first detection point where Mura appears; or the color-temperature-compensation unit being configured to increase the brightness of the blue sub-pixel in the region corresponding to the first detection point where Mura appears, and reduce the brightness of the green sub-pixel and the brightness of the red sub-pixel in the region corresponding to the first detection point where Mura appears.

In the embodiments of the disclosure, the LCD assembly is provided and includes the liquid crystal panel, the resistance detection unit, and the color-temperature-compensation unit. The liquid crystal panel has the first region and the second region. The resistance detection unit is configured to obtain the first resistance value by detecting the resistance value at the first detection point in the first region and obtain the second resistance value by detecting the resistance value at the second detection point in the second region, and further configured to obtain the resistance difference by calculating the difference between the second resistance value and the first resistance value. The color-temperature-compensation unit is configured to receive the resistance difference, determine whether Mura appears in the region corresponding to the first detection point according to the resistance difference, and perform color-temperature compensation on the pixels in the region corresponding to the first detection point according to the resistance difference when Mura appears in the region corresponding to the first detection point. As such, color Mura of the liquid crystal panel in the region corresponding to the first detection point can be reduced or even eliminated, and thus display can return to normal in the region corresponding to the first detection point, thereby improving a quality of the liquid crystal panel. Therefore, the LCD assembly is provided in the disclosure, which can determine whether Mura appears by performing resistance detection at the first detection point of the liquid crystal panel, and reduce or even eliminate Mura through color-temperature compensation, so that the quality of the liquid crystal panel can be improved.

In a second aspect, an electronic device is further provided in the embodiments of the disclosure. The electronic device includes the LCD assembly provided in the first aspect.

The electronic device is further provided in the embodiments of the disclosure. The resistance detection unit of the electronic device is configured to detect the first detection point in the first region, and the color-temperature-compensation unit of the electronic device is configured to perform color-temperature compensation on the region corresponding to the first detection point when Mura appears in the region corresponding to the first detection point, so that a display quality of the liquid crystal panel can be improved, and thus a display quality of the electronic device is improved. In addition, regular maintenance of the electronic device can be achieved by regular detection.

BRIEF DESCRIPTION OF THE DRAWINGS

To describe the technical solutions in the embodiments of the disclosure more clearly, the following briefly introduces the accompanying drawings required for describing the embodiments. Apparently, the accompanying drawings in the following description illustrate some embodiments of the disclosure. Those of ordinary skill in the art may also obtain other drawings based on these accompanying drawings without creative efforts.

DETAILED DESCRIPTION

Technical solutions in embodiments of the disclosure will be described clearly and completely hereinafter with reference to the accompanying drawings described. Apparently, the described embodiments are merely some rather than all embodiments of the disclosure. All other embodiments obtained by those of ordinary skill in the art based on the embodiments of the disclosure without creative efforts shall fall within the protection scope of the disclosure.

The terms such as "first" and "second" used in the specification, the claims, and the accompany drawings of the disclosure are used for distinguishing between different objects rather than describing a particular order. The terms "include", "comprise", and "have" as well as variations thereof are intended to cover non-exclusive inclusion. For example, a process, system, product, or apparatus including a series of steps or units is not limited to the listed steps or units, it can optionally include other operations or units that are not listed; alternatively, other operations or units inherent to the process, product, or device can be included either.

The term "embodiment" referred to herein means that a particular feature, structure, or feature described in connection with the embodiment may be contained in at least one embodiment of the disclosure. The phrase appearing in various places in the specification does not necessarily refer to the same embodiment, nor does it refer to an independent or alternative embodiment that is mutually exclusive with other embodiments. It is expressly and implicitly understood by those skilled in the art that an embodiment described herein may be combined with other embodiments.

Figure 1:
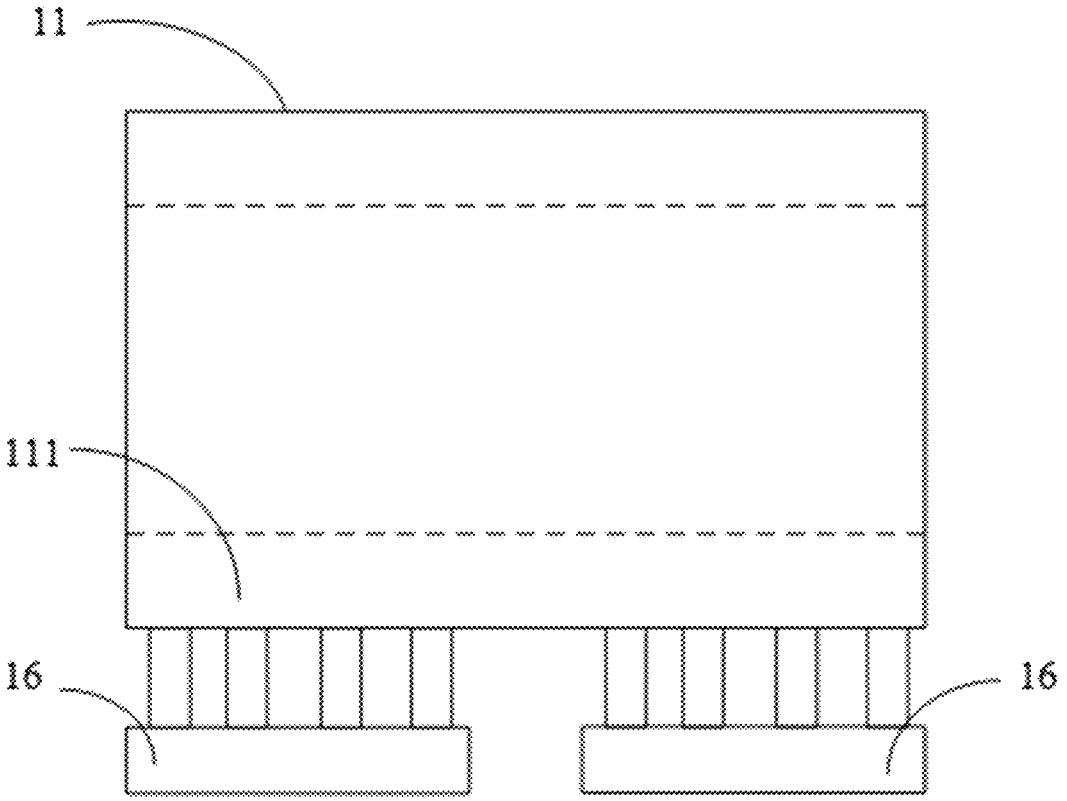
FIG. 1 is a schematic diagram illustrating A-type gravity Mura of a liquid crystal panel.
Figure 2:
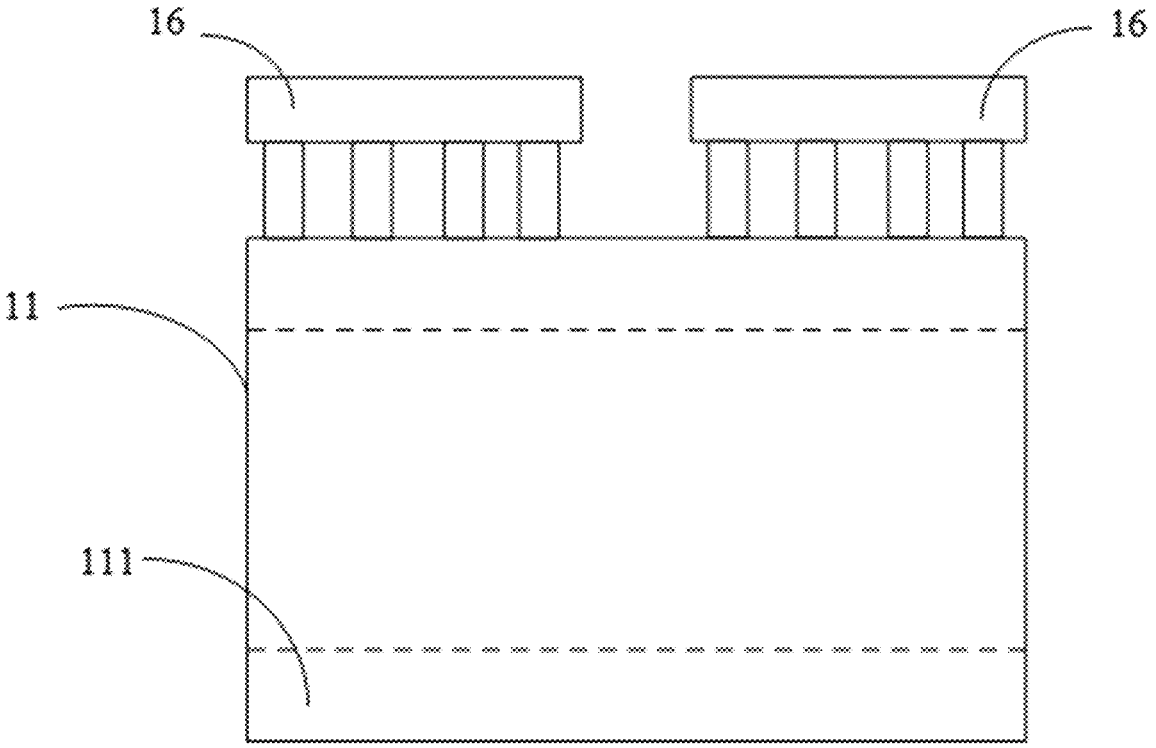
FIG. 2 is a schematic diagram illustrating B-type gravity Mura of a liquid crystal panel.

Refer to FIG. 1 and FIG. 2, FIG. 1 is a schematic diagram illustrating A-type gravity Mura of a liquid crystal panel, and FIG. 2 is a schematic diagram illustrating B-type gravity Mura of a liquid crystal panel. Generally, when a liquid crystal panel 11 is placed for a long time, liquid crystals flow downward and accumulate under the action of gravity, which may result in Gravity Mura. A position where gravity Mura appears has a high correlation with a placement of the liquid crystal panel 11. A Liquid Crystal Display (LCD) assembly 10 includes a circuit board 16 (for example, a Printed Circuit Board (PCB)) connected at a side of the liquid crystal panel 11. Currently, there are two common ways to place the liquid crystal panel 11, where one is to place the circuit board 16 downwards, which is called A-type placement, and the other is to place the circuit board 16 upwards, which is called B-type placement. During A-type placement, gravity Mura usually appears in a first region 111 of the liquid crystal panel 11 close to the circuit board 16, which is called A-type gravity Mura. During B-type placement, gravity Mura usually appears in a first region 111 of the liquid crystal panel 11 away from the circuit board 16, which is called B-type gravity Mura.

It is noted that, in the disclosure, an example that the liquid crystal panel 11 is not connected to a circuit board is taken for illustration, and type-A gravity Mura and type-B gravity Mura are collectively referred to as gravity Mura that appears in the vicinity of ends of the liquid crystal panel 11.

Figure 3:
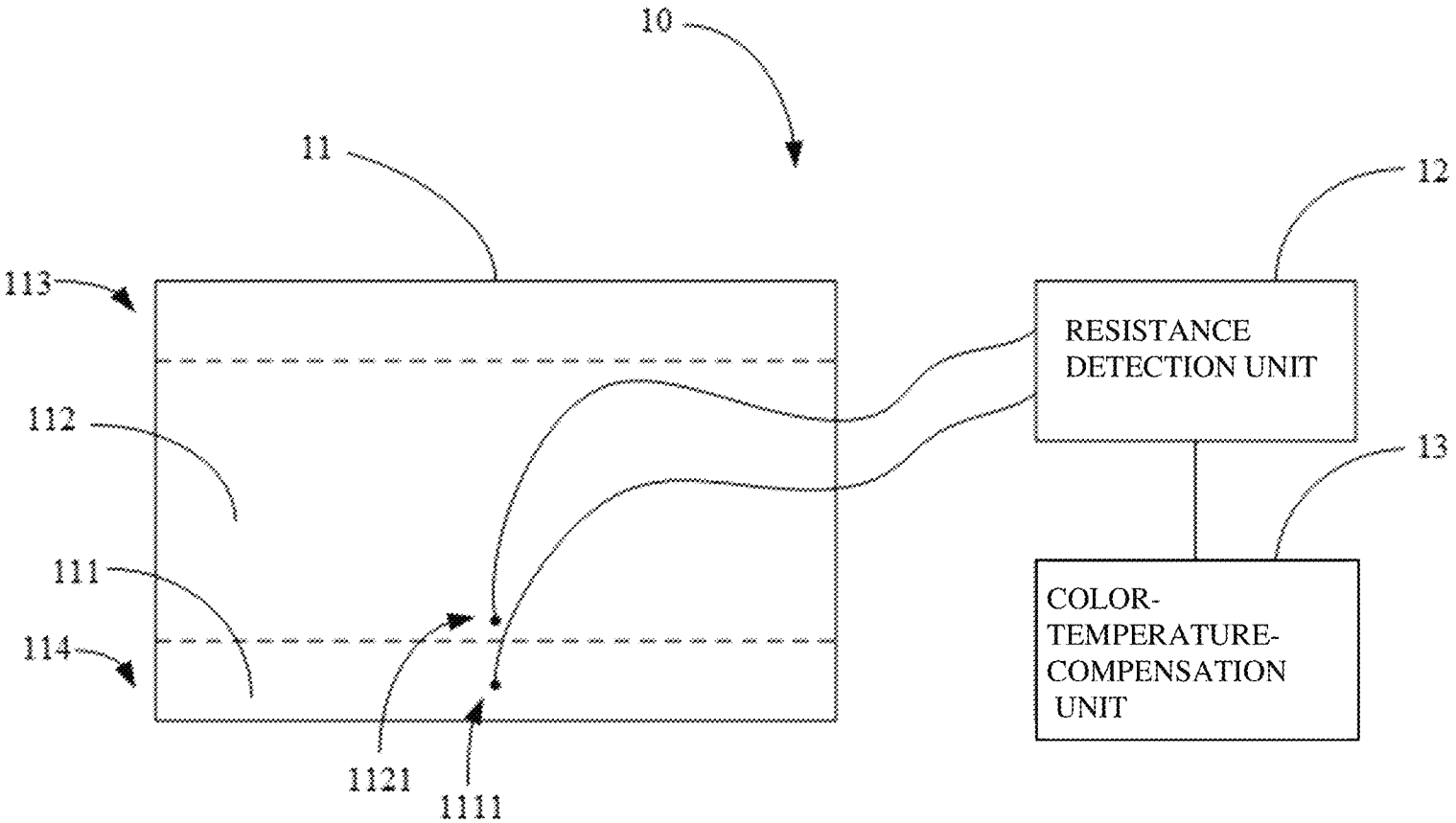
FIG. 3 is a schematic structural diagram of a Liquid Crystal Display (LCD) assembly provided in an embodiment of the disclosure.
Figure 4:
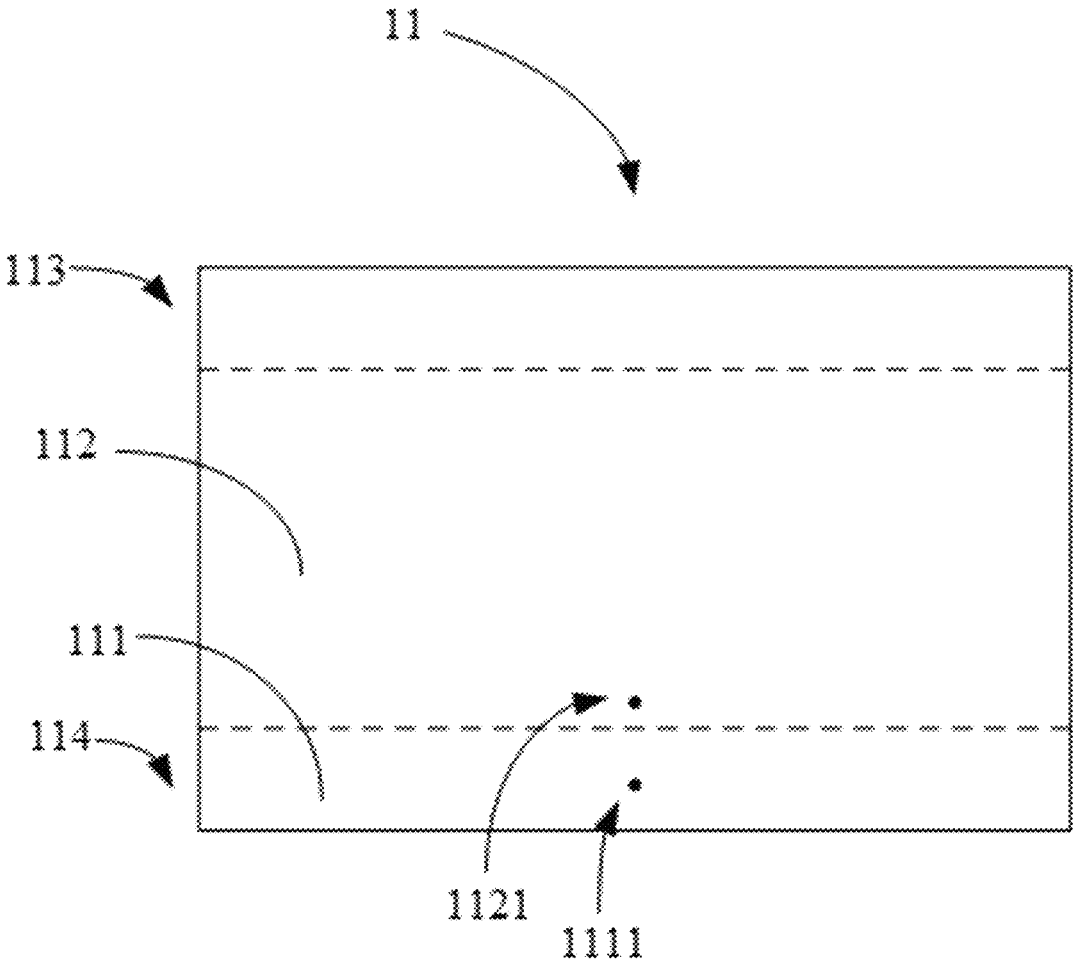
FIG. 4 is a schematic structural diagram of a liquid crystal panel in the LCD assembly illustrated in FIG. 3 according to an embodiment.

An LCD assembly is provided in the disclosure. The liquid crystal panel 11 is widely used in various electronic devices, such as mobile phones, computers, or televisions. Refer to FIG. 3 and FIG. 4, FIG. 3 is a schematic structural diagram of an LCD assembly provided in an embodiment of the disclosure, and FIG. 4 is a schematic structural diagram of a liquid crystal panel in the LCD assembly illustrated in FIG. 3 according to an embodiment. In the embodiments, the LCD assembly 10 includes the liquid crystal panel 11, a resistance detection unit 12, and a color-temperature-compensation unit 13. The liquid crystal panel 11 has the first region 111 and a second region 112. The first region 111 is located at least one of a top portion 113 or a bottom portion 114 of the liquid crystal panel 11. The second region 112 is closer to a center of the liquid crystal panel 11 than the first region 111. The liquid crystal panel 11 has a first detection point 1111 in the first region 111 and a second detection point 1121 in the second region 112. The resistance detection unit 12 is configured to obtain a first resistance value by detecting a resistance value at the first detection point 1111 and obtain a second resistance value by detecting a resistance value at the second detection point, and further configured to obtain a resistance difference by calculating a difference between the second resistance value and the first resistance value. The color-temperature-compensation unit 13 is electrically connected to the resistance detection unit 12, configured to receive the resistance difference, determine whether Mura appears in a region corresponding to the first detection point 1111 in the first region 111 according to the resistance difference, and perform color-temperature compensation on pixels in the region corresponding to the first detection point 1111 according to the resistance difference when Mura appears in the region corresponding to the first detection point 1111.

The liquid crystal panel 11 has the first region 111 and the second region 112. The first region 111 is in at least one of the top portion 113 or the bottom portion 114 of the liquid crystal panel 11. In the embodiments, as an example, there is one first region 111, and the one first region 111 is only in the bottom portion 114 of the liquid crystal panel 11. It is noted that, in other embodiments, the first region 111 may be only in the top portion 113 of the liquid crystal panel 11. Alternatively, in other embodiments, there are two first regions 111, and one of the two first regions 111 is in the top portion 113 of the liquid crystal panel 11, and the other of the two first regions 111 is in the bottom portion 114. Usually, during the production process of the liquid crystal panel 11, some production flaws may occur due to unavoidable process fluctuations during mass production in factors such as array film thickness, RGB film thickness, polyimide (PI) film thickness, and pillar spacer (PS) height, such that gravity Mura generally appears in the first region 111 after the liquid crystal panel 11 is placed for a period of time. It is noted that, gravity Mura refers to the uneven display phenomenon in the bottom portion 114 when the liquid crystal panel 11 is powered on. Since before the liquid crystal panel 11 is mounted to an electronic device 1, it may not be specified that the top portion 113 of the liquid crystal panel 11 will be at the top of the electronic device 1 and the bottom portion 114 of the liquid crystal panel 11 will be at the bottom of the electronic device 1, or since the electronic device 1 can be rotated by 180 degrees for use, gravity Mura may appear in at least one of the bottom portion 114 or the top portion 113 of the liquid crystal panel 11.

In an embodiment, a ratio of a size of one first region 111 in a direction from the top portion 113 to the bottom portion 114 to a size of the liquid crystal panel 11 in the direction from the top portion 113 to the bottom portion 114 ranges from 1/6 to 1/3. In other embodiments, there is no limitation on the ratio of the size of one first region 111 in the direction from the top portion 113 to the bottom portion 114 to the size of the liquid crystal panel 11 in the direction from the top portion 113 to the bottom portion 114.

Specifically, the ratio of the size of one first region 111 in the direction from the top portion 113 to the bottom portion 114 to the size of the liquid crystal panel 11 in the direction from the top portion 113 to the bottom portion 114 may be but is not limited to 1/6, 1/5, 1/4, or 1/3. It is noted that, the ratio of the size of one first region 111 in the direction from the top portion 113 to the bottom portion 114 to the size of the liquid crystal panel 11 in the direction from the top portion 113 to the bottom portion 114 may be other values, as long as the ratio falls within a range of 1/6 to 1/5.

When the ratio of the size of one first region 111 in the direction from the top portion 113 to the bottom portion 114 to the size of the liquid crystal panel 11 in the direction from the top portion 113 to the bottom portion 114 is less than 1/6, there may be missed detection of a region where Mura appears on the liquid crystal panel 11. When the ratio of the size of one first region 111 in the direction from the top portion 113 to the bottom portion 114 to the size of the liquid crystal panel 11 in the direction from the top portion 113 to the bottom portion 114 is greater than 1/3, a detection may be performed on a region of the liquid crystal panel 11 where gravity Mura does not appear or a region where gravity Mura is less likely to appear, resulting in increased detection time, waste of manpower and material resources, and increased detection costs. In the embodiments of the disclosure, the ratio of the size of one first region 111 in the direction from the top portion 113 to the bottom portion 114 to the size of the liquid crystal panel 11 in the direction from the top portion 113 to the bottom portion 114 ranges from 1/6 to 1/3, and thus when detecting gravity Mura on the liquid crystal panel 11, it is possible to improve an utilization efficiency of manpower and material resources, reduce the detection cost, and avoid missed detection of a region where gravity Mura may appear on the liquid crystal panel 11.

When gravity Mura appears in the first region 111, the first region 111 will generate a slight glass deformation at a position where Mura appears, and a conductive layer of the liquid crystal panel 11 is stretched at a position where deformation occurs, resulting in a decrease in cross section, which in turn causes an increment in resistance. The conductive layer may be, but is not limited to, Indium Tin Oxide (ITO) or nano-silver. The conductive layer may be, but is not limited to, a gate line, a data line, or a common electrode line in the liquid crystal panel 11.

In the embodiments, the first region 111 has the first detection point 1111. The resistance detection unit 12 may be electrically connected to the first detection point 1111 and obtain the first resistance value by performing resistance detection. The second region 112 has the second detection point 1121. The resistance detection unit 12 may be electrically connected to the second detection point 1121 and obtain the second resistance value by performing resistance detection. As such, the resistance detection unit 12 may obtain the resistance difference by calculating the difference between the second resistance value and the first resistance value. The resistance detection unit 12 may be a point analysis chip, and have functions such as resistance detection and calculation. In other embodiments, the resistance detection unit 12 may also be other chips or circuits, as long as the resistance detection unit 12 has resistance detection and calculation functions.

In an embodiment, a line is reserved at a common electrode of the first region 111 or at a place where static electricity is discharged (for example, a Color Filter (CF) glass surface or a Thin Film Transistor (TFT) glass surface), so that the resistance detection unit 12 can be electrically connected to the first detection point 1111. Correspondingly, a line is reserved at a common electrode of the second region 112 or at a place where static electricity is discharged (for example, the CF glass surface or the TFT glass surface), so that the resistance detection unit 12 can be electrically connected to the second detection point 1121. By means of reserved lines for resistance detection, the liquid crystal panel 11 does not need to be disassembled during detection, and resistance detection can be performed with aid of direct electrical connections with the reserved lines, so that detection speed and efficiency can be improved, and the liquid crystal panel 11 can be avoided from being damaged.

The closer the second detection point 1121 is to the first detection point 1111, the greater the resistance difference when the same degree of Mura appears. Therefore, the second detection point 1121 is set as close as possible to the first detection point 1111. However, the second detection point 1121 needs to be set in the second region 112 where Mura does not or is less likely to appear, such that Mura does not affect the second resistance value, and accordingly, a determination of whether Mura appears according to the resistance difference is not affected. Specifically, the second detection point 1121 may be spaced apart from the first region 111 by but not limited to 1 to 10 pixels.

The color-temperature-compensation unit 13 is electrically connected to the resistance detection unit 12 to receive the resistance difference, and determine whether Mura appears in a region corresponding to the first detection point 1111 in the first region 111 according to the resistance difference. The color-temperature-compensation unit 13 may be a timing control chip (Tcon IC), which has calculation and color-temperature compensation functions. In other embodiments, the color-temperature-compensation unit 13 may also be other chips or circuits, as long as the color-temperature-compensation unit 13 has calculation and color-temperature compensation functions.

When the resistance difference is greater than a preset resistance value, the color-temperature-compensation unit 13 may determine that Mura appears in the region corresponding to the first detection point 1111 in the first region 111, otherwise, the color-temperature-compensation unit 13 may determine that no Mura appears in the region corresponding to the first detection point 1111 in the first region 111. For example, the preset resistance value may be, but is not limited to, 0.1 Ω, 0.2 Ω, or 0.5 Ω. When Mura appears in the region corresponding to the first detection point 1111, the color-temperature-compensation unit 13 performs the color-temperature compensation on the pixels in the region corresponding to the first detection point 1111 according to the resistance difference, so that display can return to normal in the region corresponding to the first detection point 1111 where Mura appears.

It is noted that, the region corresponding to the first detection point 1111 may be, but is not limited to, the entire first region 111, a row of pixel regions where the first detection point 1111 is located, or a rectangular or circular region with the first detection point 1111 as a center.

Specifically, the LCD assembly 10 may be applied to but not limited to the following scenarios.

Before the production line of the liquid crystal panel 11 is completed, the resistance detection unit 12 may obtain the first resistance value by performing resistance detection on the first detection point 1111 of the liquid crystal panel 11, obtain the second resistance value by performing resistance detection on the second detection point 1121, and obtain the resistance difference by calculating the difference between the second resistance value and the first resistance value. The color-temperature-compensation unit 13 may receive the resistance difference, determine whether the resistance difference is greater than the preset resistance value, and then determine whether Mura appears in the region corresponding to the first detection point 1111 in the first region 111. If Mura appears, the color-temperature-compensation unit 13 may perform color-temperature compensation on the pixels in the region corresponding to the first detection point 1111 where Mura appears, so that display can return to normal in the region corresponding to the first detection point 1111 where Mura appears, thereby improving a production quality of the liquid crystal panel 11, and in turn improving a yield.

When the liquid crystal panel 11 is delivered to clients, the resistance detection unit 12 is used to obtain the first resistance value by performing resistance detection on the first detection point 1111 of the liquid crystal panel 11, obtain the second resistance value by performing resistance detection on the second detection point 1121, and obtain the resistance difference by calculating the difference between the second resistance value and the first resistance value. The color-temperature-compensation unit 13 receives the resistance difference, determines whether the resistance difference is greater than the preset resistance value, and then determines whether Mura appears in the region corresponding to the first detection point 1111 in the first region 111. If Mura appears, the color-temperature-compensation unit 13 performs color-temperature compensation on the pixels in the region corresponding to the first detection point 1111 where Mura appears, so that display can return to normal in the region corresponding to the first detection point 1111 where Mura appears, thereby improving a delivery quality of the liquid crystal panel 11, in turn reducing clients' complaints and returns and exchanges, and thus reducing losses.

During the service life of the liquid crystal panel 11, the resistance detection unit 12 may regularly or irregularly obtain the first resistance value by performing resistance detection on the first detection point 1111 of the liquid crystal panel 11, obtain the second resistance value by performing resistance detection on the second detection point 1121, and obtain the resistance difference by calculating the difference between the second resistance value and the first resistance value. The color-temperature-compensation unit 13 may receive the resistance difference, determine whether the resistance difference is greater than the preset resistance value, and then determine whether Mura appears in the region corresponding to the first detection point 1111 in the first region 111. If Mura appears, the color-temperature-compensation unit 13 performs color-temperature compensation on the pixels in the region corresponding to the first detection point 1111 where Mura appears, so that display can return to normal in the region corresponding to the first detection point 1111 where Mura appears, thereby improving a usage experience of the liquid crystal panel 11, and thus reducing returns and exchanges of clients.

It is noted that the above scenarios are merely exemplary, and not intent to limit the application range of the LCD assembly 10 provided in the disclosure.

As stated above, the LCD assembly 10 is provided in the disclosure. The LCD assembly 10 includes the liquid crystal panel 11, the resistance detection unit 12, and the color-temperature-compensation unit 13. The liquid crystal panel 11 has the first region 111 and the second region 112. The resistance detection unit 12 is configured to obtain the first resistance value by detecting the resistance value at the first detection point 1111 in the first region 111 and obtain the second resistance value by detecting the resistance value at the second detection point 1121 in the second region 112, and further configured to obtain the resistance difference by calculating the difference between the second resistance value and the first resistance value. The color-temperature-compensation unit 13 is configured to receive the resistance difference, determine whether Mura appears in the region corresponding to the first detection point 1111 according to the resistance difference, and perform color-temperature compensation on the pixels in the region corresponding to the first detection point 1111 according to the resistance difference when Mura appears in the region corresponding to the first detection point 1111. As such, color of the liquid crystal panel 11 in the region corresponding to the first detection point 1111 that is generated due to Mura can be reduced or even eliminated, and thus display can return to normal in the region corresponding to the first detection point 1111, thereby improving a quality of the liquid crystal panel 11. Therefore, the LCD assembly 10 is provided in the disclosure, which can determine whether Mura appears by performing resistance detection at the first detection point 1111 of the liquid crystal panel 11, and reduce or even eliminate Mura through color-temperature compensation, so that the quality of the liquid crystal panel 11 can be improved.

Figure 5:
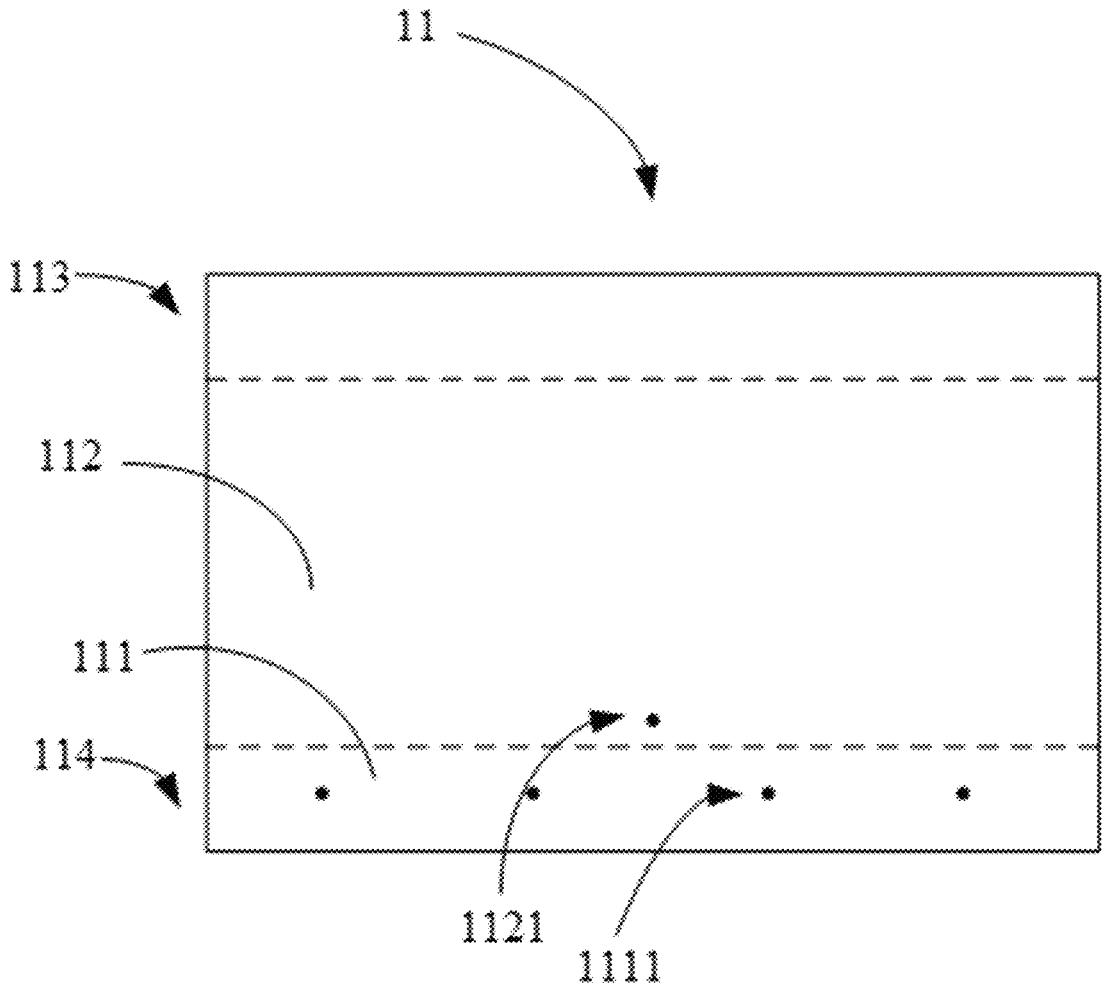
FIG. 5 is a schematic structural diagram of a liquid crystal panel in the LCD assembly illustrated in FIG. 3 according to an embodiment.
Figure 6:
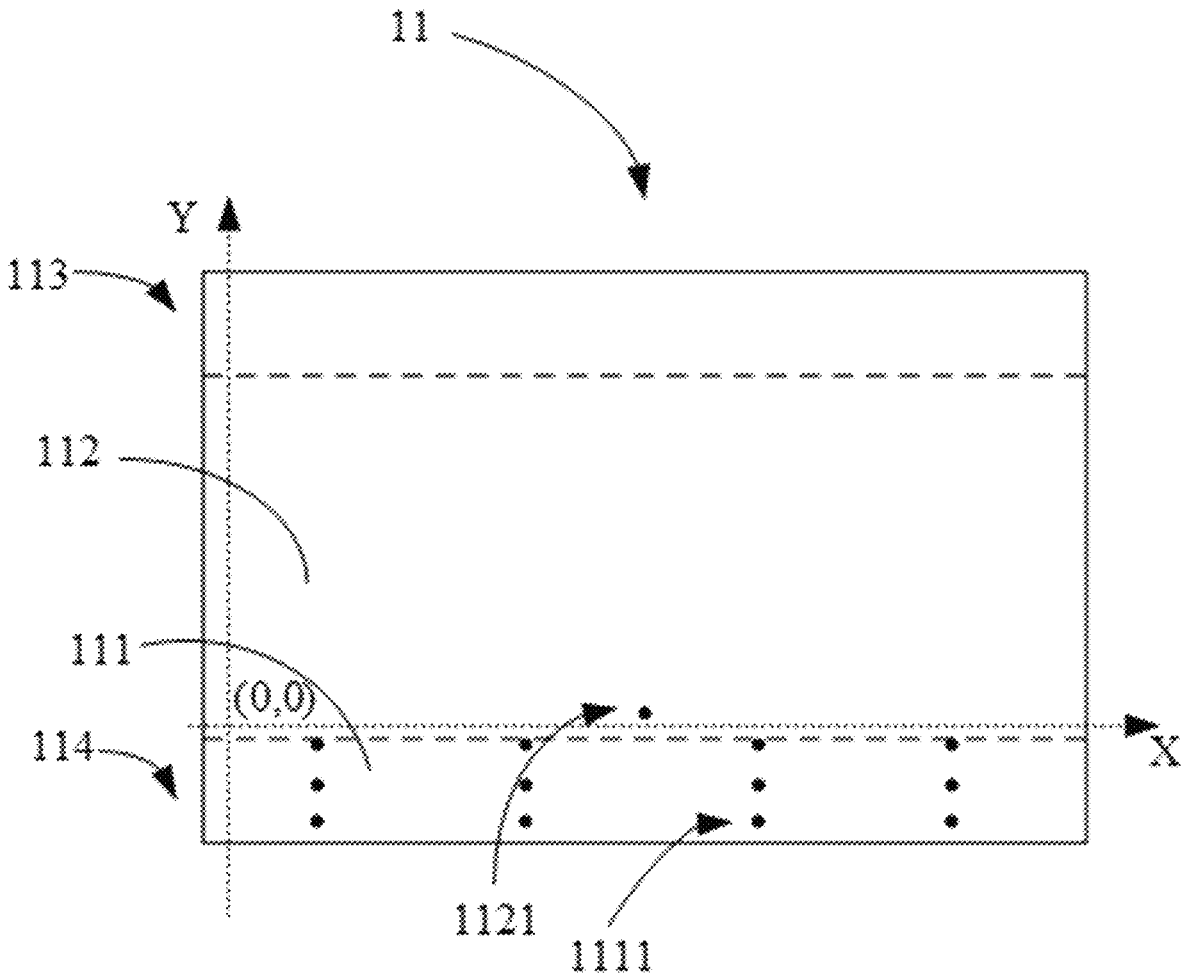
FIG. 6 is a schematic structural diagram of a liquid crystal panel in the LCD assembly illustrated in FIG. 3 according to an embodiment.

Refer to FIG. 5 and FIG. 6, FIG. 5 is a schematic structural diagram of a liquid crystal panel in the LCD assembly illustrated in FIG. 3 according to an embodiment, and FIG. 6 is a schematic structural diagram of a liquid crystal panel in the LCD assembly illustrated in FIG. 3 according to an embodiment. The liquid crystal panel 11 has multiple first detection points 1111 in the first region 111 and one second detection point 1121 in the second region 112. The resistance detection unit 12 is configured to obtain multiple first resistance values by detecting resistance values at the multiple first detection points 1111 in a first preset sequence, and further configured to obtain multiple resistance differences by calculating a difference between the second resistance value and each of the multiple first resistance values. The color-temperature-compensation unit 13 is configured to receive the multiple resistance differences, determine whether Mura appears in a region corresponding to each of the multiple first detection points 1111 in the first region 111 according to the multiple resistance differences, and perform color-temperature compensation on pixels in each region where Mura appears according to the multiple resistance differences.

In the embodiments, there are multiple first detection points 1111 in the first region 111, and it is possible to perform detection on more regions in the first region 111 through the multiple first detection points 1111, which is suitable for a liquid crystal panel 11 having a large size. The number of the first detection points 1111 may be set according to a size of the liquid crystal panel 11. Generally, the larger the liquid crystal panel 11, the more the first detection points 1111, so that more comprehensive detection of whether Mura appears can be performed on the first region 111. Also, when the size of the liquid crystal panel 11 remains unchanged, an increase in the number of the first detection points 1111 may make the region corresponding to each first detection point 1111 relatively small, so that more detailed detection of whether Mura appears can be performed on the first region 111. In addition, a specific number of the first detection points 1111 may be set based on actual effects and costs. An increase in the number of the first detection points 1111 may lead to an increase in cost (that is, integrated circuit (IC) is more expensive). Once the number of the first detection points 1111 reaches a certain value, image quality may not be improved significantly.

For example, in an embodiment (see FIG. 5), a row of first detection points 1111 is provided in the first region 111, which may be applied to but is not limited to a liquid crystal panel 11 having a small size, so that detection costs can be reduced. In another embodiment (see FIG. 6), multiple rows of first detection points 1111 are provided in the first region 111, which may be applied to but is not limited to a liquid crystal panel 11 having a large size, so that a more comprehensive detection can be performed on the liquid crystal panel 11. It is noted that the number of the first detection points 1111 in FIG. 5 and the number of the first detection points 111 in FIG. 6 are only exemplary for illustration, which are not limited herein.

Since the first region 111 has multiple first detection points 1111, the resistance detection unit 12 may obtain multiple first resistance values at the multiple first detection points 1111. Part of the multiple first resistance values may be equal, that is, some resistance differences may be equal. As a result, for each of equal resistance differences, it is difficult for the color-temperature-compensation unit 13 to determine that the resistance difference corresponds to a region corresponding to which first detection point 1111. In the embodiments, the resistance detection unit 12 is configured to obtain multiple first resistance values by detecting resistance values at the multiple first detection points 1111 in a preset sequence, so that the multiple resistance differences obtained by calculating the difference between each second resistance value and each of the first resistance values by the resistance detection unit 12 are sequential. Thus, the color-temperature-compensation unit 13 can determine the first detection point 1111 corresponding to each resistance difference based on the first preset sequence. The resistance detection unit 12 is a point analysis chip, which has functions of resistance detection, timing setting, and calculation. In other embodiments, the resistance detection unit 12 may also be other chips or circuits, as long as the resistance detection unit 12 has the functions of resistance detection, timing setting, and calculation.

Specifically, an example illustrated in FIG. 6 is taken for illustration, where a coordinate system is established, the first detection point 1111 has an abscissa of Xm and an ordinate of Yn, the second resistance value at the second detection point 1121 corresponding to the coordinates (Xm, Yn) is Ri, and the first resistance value corresponding to the coordinates (Xm, Yn) is Ri', where m, n, and i are all natural numbers greater than zero. (Xm, Yn) Ri indicates that the second resistance value at the second detection point 1121 corresponding to the first detection point 1111 at the coordinates (Xm, Yn) is Ri. (Xm, Yn) Ri' indicates that the first resistance value at the first detection point 1111 at the coordinates (Xm, Yn) is Ri'. The resistance difference at the coordinates (Xm, Yn) is expressed as (Xm, Yn) $\Delta Ri=(Ri'-Ri)$. The first preset sequence is a sequence in which the resistance detection unit 12 detects the resistance values at the first detection points 1111, and the first preset sequence may be but is not limited to the following. First select part of the first detection points 1111 corresponding to a coordinate of m=1, perform resistance detection on part of the first detection points 1111 corresponding to the coordinate of m=1 in an ascending sequence of a coordinate of n, and then select another part of the first detection points 1111 corresponding to a coordinate of m=2, perform resistance detection on the another part of the first detection points 1111 corresponding to the coordinate of m=2 in an ascending sequence of a coordinate of n, and so on until resistance detection is performed on all the first detection points 1111. Alternatively, first select part of the first detection points 1111 corresponding to a coordinate of n=1, perform resistance detection on the part of the first detection points 1111 corresponding to the coordinate of n=1 in an ascending sequence of a coordinate of m, and then select another part of the first detection points 1111 corresponding to a coordinate of n=2, perform resistance detection on the another part of the first detection points 1111 corresponding to the coordinate of n=2 in an ascending sequence of a coordinate of m, and so on until resistance detection is performed on all the first detection points 1111. Alternatively, resistance detection can be performed on the multiple first detection points 1111 according to arbitrary value rules of m and n, as long as the color-temperature-compensation unit 13 can distinguish resistance changes corresponding to different first detection points 1111 according to a sequence of performing resistance detection on the multiple first detection points 1111.

For example, twelve first detection points 1111 are taken as an example for illustration, where the twelve first detection points 1111 are distributed in the first region 111 in 3 rows×4 columns. When no gravity Mura appears on the liquid crystal panel 11, there is a standard resistance value at each first detection point 1111, and the standard resistance value is equal to the second resistance value at the corresponding second detection point 1121. Since there is only one second detection point 1121 in the embodiment, a reference resistance value for each first detection point 1111 is the same. The resistance detection unit 12 is configured to record the second resistance value Ri into corresponding coordinates in the first preset sequence, specifically, (Xm, Yn) Ri=(R1, R2, R3, R4, R5, R6, R7, R8, R9, R10, R11, R12). In addition, the resistance detection unit 12 is configured to obtain resistance values at the twelve first detection points 1111 in the first preset sequence to obtain twelve first resistance values Ri', and records the twelve first resistance values into corresponding coordinates, specifically, (Xm, Yn) Ri'=(R1', R2', R3', R4', R5', R6', R7', R8', R9', R10', R11', R12'). The resistance difference is expressed as (Xm, Yn) $\Delta Ri=(Ri'-Ri)$. The color-temperature-compensation unit 13 is configured to determine whether Mura appears in a region at corresponding coordinates according to the resistance difference at each first detection point 1111, and perform color-temperature compensation on the region where Mura appears according to a corresponding resistance difference.

It is noted that there is no limitation on the number and distribution of the first detection points 1111 in the embodiment.

Therefore, the resistance detection unit 12 is configured to obtain the resistance values at the multiple first detection points 1111 in the first preset sequence, so that the color-temperature-compensation unit 13 does not confuse resistance changes corresponding to the multiple first detection points 1111, and thus the color-temperature-compensation unit 13 has an improved compensation on a region where Mura appears in the first region 111.

Figure 7:
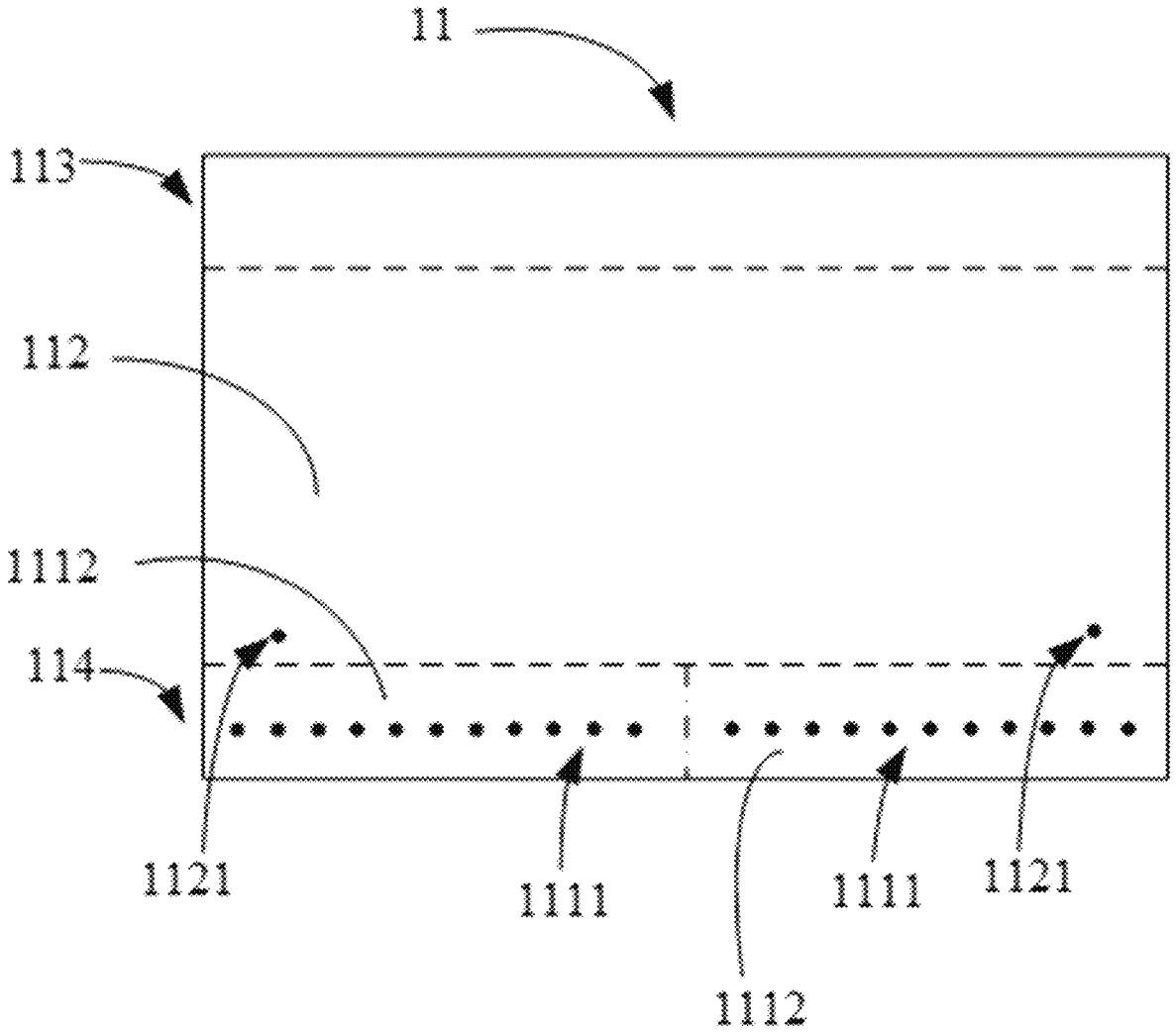
FIG. 7 is a schematic structural diagram of a liquid crystal panel in the LCD assembly illustrated in FIG. 3 according to an embodiment.
Figure 8:
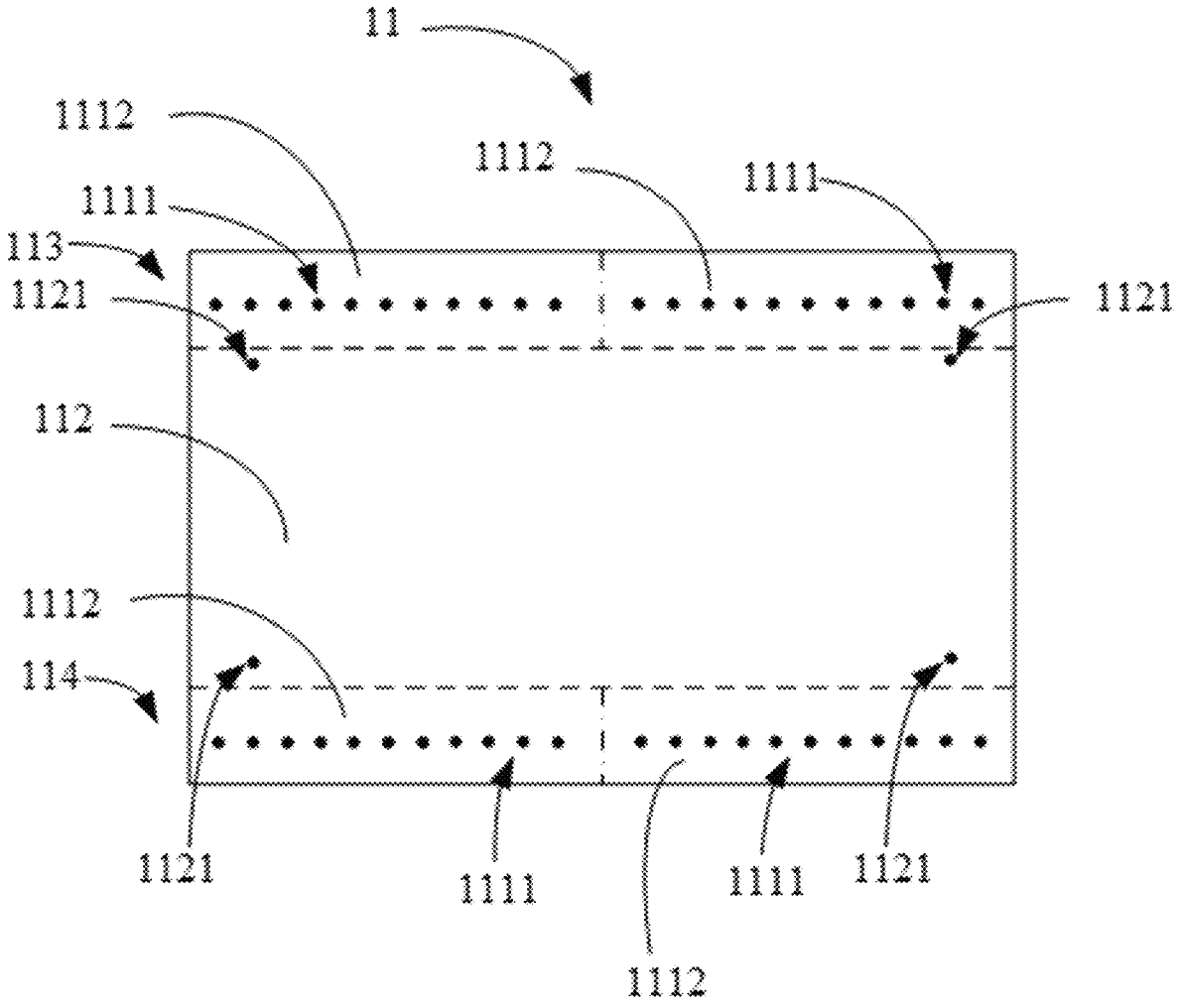
FIG. 8 is a schematic structural diagram of a liquid crystal panel in the LCD assembly illustrated in FIG. 3 according to an embodiment.
Figure 9:
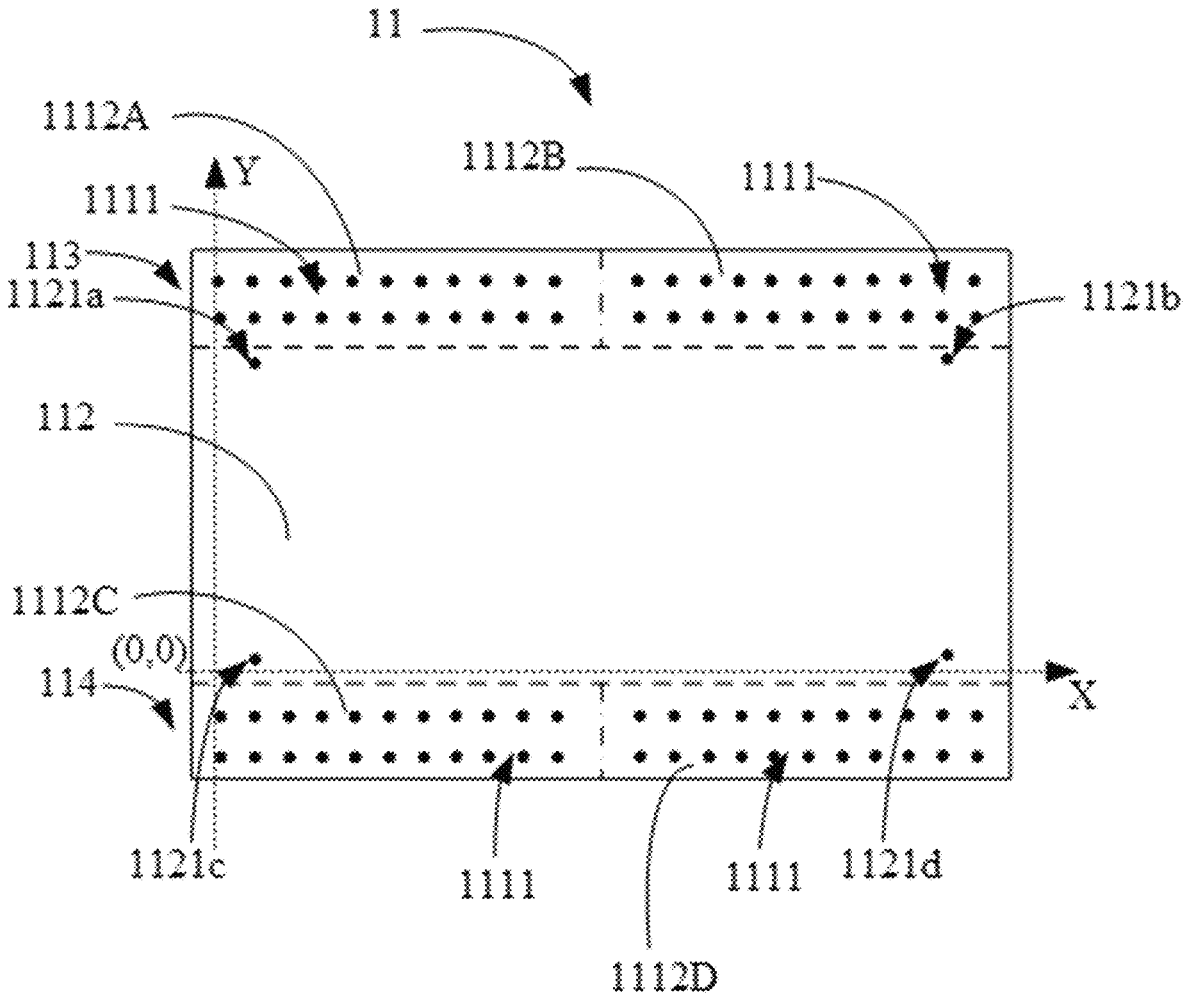
FIG. 9 is a schematic structural diagram of a liquid crystal panel in the LCD assembly illustrated in FIG. 3 according to an embodiment.

Refer to FIG. 7, FIG. 8, and FIG. 9, FIG. 7 is a schematic structural diagram of a liquid crystal panel in the LCD assembly illustrated in FIG. 3 according to an embodiment, FIG. 8 is a schematic structural diagram of a liquid crystal panel in the LCD assembly illustrated in FIG. 3 according to an embodiment, and FIG. 9 is a schematic structural diagram of a liquid crystal panel in the LCD assembly illustrated in FIG. 3 according to an embodiment. In the embodiments, the first region 111 includes multiple sub-regions 1112, where each of the multiple sub-regions 1112 includes multiple first detection points 1111, the second region 112 includes multiple second detection points 1121, and each of the multiple second detection points 1121 corresponds to one of the multiple sub-regions 1112. The resistance detection unit 12 is configured to obtain multiple first resistance values by detecting resistance values at the multiple first detection points 1111 in a second preset sequence. The resistance detection unit 12 is configured to obtain multiple second resistance values by detecting resistance values at the multiple second detection points 1121 in a third preset sequence, and obtain multiple sub-resistance differences by calculating a difference between each second resistance value and each of the first sub-resistance values obtained by detecting resistance values at the first detection points 1111 in a corresponding sub-region 1112. The color-temperature-compensation unit 13 is configured to receive the multiple sub-resistance differences, determine whether Mura appears in a region corresponding to each of the multiple first detection points 1111 in the first region 111 according to the multiple sub-resistance differences, and perform color-temperature compensation on pixels in each region where Mura appears according to the multiple sub-resistance differences.

The multiple sub-regions 1112 are set in the first region 111 and the multiple second detection points 1121 are set in the second region 112, and one second detection point 1121 corresponds to one sub-region 1112, so that detection of whether Mura appears in the first region 111 is more subdivided.

The number of the sub-regions 1112 and the number of the first detection points 1111 may vary according to the size and type of the liquid crystal panel 11. Specifically, if the liquid crystal panel 11 has a large size, there is a possibility that resistance changes at two first detection points 1111 that are far away from each other in the first region 111 may have a large difference, by setting the multiple sub-regions 1112 in the first region 111 and setting the multiple second detection points 1121 in the second region 112, and making one second detection point 1121 correspond to one sub-region 1112, the first detection points 1111 in different sub-regions 1112 in the first region 111 may take different second detection points 1121 as reference, respectively, so that detection of whether Mura appears in the first region 111 is more comprehensive.

In addition, when the liquid crystal panel 11 is not large, by setting the multiple sub-regions 1112 in the first region 111 and setting the multiple second detection points 1121 in the second region 112, and making one second detection point 1121 correspond to one sub-region 1112, the first detection points 1111 in different sub-regions 1112 in the first region 111 may take different second detection points 1121 as reference, respectively, so that detection accuracy of a resistance change at each first detection point 1111 in the first region 111 may be improved. In addition, a specific number of the first detection point 1111 may be set based on actual effects and costs. An increase in the number of the first detection points 1111 may lead to an increase in cost (that is, IC is more expensive). Once the number of the first detection points 1111 reaches a certain value, image quality may not be improved significantly.

In addition, when a placement manner of the liquid crystal panel 11 is fixed, the first region 111 only needs to be arranged in the bottom portion 114. When the liquid crystal panel 11 is placed in a rotatable manner, the first regions 111 are arranged at both the bottom portion 114 and the top portion 113, facilitating detection and color-temperature compensation on a region where Mura appears in the liquid crystal panel 11.

According to an actual size, actual application requirements, and a fluctuating degree of a factory process of the liquid crystal panel 11, the liquid crystal panel 11 may be provided with one first region 111 or two first regions 111, or the liquid crystal panel 11 may be provided with two first regions 111 and multiple rows of first detection points 1111 in each first region 111, so that a deformation at each position can be monitored, and a display color at each position can be accurately corrected. For example, in an embodiment (refer to FIG. 7), the first region 111 is only set in the bottom portion 114, and the first detection points 1111 are distributed in one row in the first region 111. In another embodiment (refer to FIG. 8), there are two first regions 111, and one of the two first regions 111 is set in the top portion 113, the other one is set in the bottom portion 114, and the first detection points 1111 are distributed in one row in each first region 111. In yet another embodiment (refer to FIG. 9), there are two first regions 111, one of the two first regions 111 is set in the top portion 113, the other one is set in the bottom portion 114, and the first detection points 1111 are distributed in multiple rows in each first region 111. Not limited thereto, in other embodiments, the number of rows of the first detection points 1111 in each first region 111 can be set arbitrarily, which is determined according to actual applications. It is noted that, the number and distribution of the sub-regions 1112, the number and distribution of the first detection points 1111, and the number and distribution of the second detection points 1121 illustrated in FIG. 7, FIG. 8, and FIG. 9 are merely exemplary, which are not intend to limit the number and distribution of the sub-regions 1112, the number and distribution of the first detection points 1111, and the number and distribution of the second detection points 1121.

Since the first region 111 has the multiple first detection points 1111, the resistance detection unit 12 may obtain multiple first resistance values at the multiple first detection points 1111. Some of the multiple first resistance values may be equal, and thus it is difficult for the resistance detection unit 12 to determine that each first resistance value corresponds to a region corresponding to which first detection point 1111.

In addition, the second region 112 has the multiple second detection points 1121, and the resistance detection unit 12 may obtain multiple second resistance values at the multiple second detection points 1121. Some of the second resistance values may be equal, and thus it is difficult for the resistance detection unit 12 to determine the second detection point 1121 to which each second resistance value corresponds, and determine the sub-region 1112 to which each second detection point 1121 corresponds.

In the embodiments, the resistance detection unit 12 is configured to obtain multiple first resistance values by detecting resistance values at the multiple first detection points 1111 in the second preset sequence, and to obtain multiple second resistance values by detecting resistance values at the multiple second detection points 1121 in the third preset sequence, where the third preset sequence corresponds to the second preset sequence in which the multiple sub-regions 1112 are detected, so that the multiple resistance differences obtained by calculating the difference between each second resistance value and each of the first resistance values by the resistance detection unit 12 are sequential. Thus, the color-temperature-compensation unit 13 can determine the first detection point 1111 corresponding to each resistance difference based on the second preset sequence and the third preset sequence. The resistance detection unit 12 is a point analysis chip, which has functions of resistance detection, timing setting, and calculation. In other embodiments, the resistance detection unit 12 may also be other chips or circuits, as long as the resistance detection unit 12 has the functions of resistance detection, timing setting, and calculation.

Specifically, refer to FIG. 9, a coordinate system is established, the first detection point 1111 has an abscissa of Xm and an ordinate of Yn, the second resistance value at the second detection point 1121 corresponding to the coordinates (Xm, Yn) is Ri, and the first resistance value corresponding to the coordinates (Xm, Yn) is Ri', where m, n, and i are all natural numbers greater than zero. (Xm, Yn) Ri indicates that the second resistance value at the second detection point 1121 corresponding to the first detection point 1111 at the coordinates (Xm, Yn) is Ri. (Xm, Yn) Ri' indicates that the first resistance value at the first detection point 1111 at the coordinates (Xm, Yn) is Ri'. The resistance difference at the coordinates (Xm, Yn) is expressed as (Xm, Yn) ΔRi=(Ri'−Ri). The second preset sequence is a sequence in which the resistance detection unit 12 detects the resistance values at the first detection points 1111, and the second preset sequence may be but is not limited to the following. First select part of the first detection points 1111 corresponding to a coordinate of m=1, perform resistance detection on the part of the first detection points 1111 corresponding to the coordinate of m=1 in an ascending sequence of a coordinate of n, and then select another part of the first detection points 1111 corresponding to a coordinate of m=2, perform resistance detection on the another part of the first detection points 1111 corresponding to the coordinate of m=2 in an ascending sequence of a coordinate of n, and so on until resistance detection is performed on all of the first detection points 1111. Alternatively, first select part of the first detection points 1111 corresponding to a coordinate of n=1, perform resistance detection on the part of the first detection points 1111 corresponding to the coordinate of n=1 in an ascending sequence of a coordinate of m, and then select another part of the first detection points 1111 corresponding to a coordinate of n=2, perform resistance detection on the another part of the first detection points 1111 corresponding to the coordinate of n=2 in an ascending sequence of a coordinate of m, and so on until resistance detection is performed on all of the first detection points 1111. Alternatively, resistance detection can be performed on the multiple first detection points 1111 according to arbitrary value rules of m and n, as long as a sequence of performing resistance detection on the multiple first detection points 1111 is identifiable. In addition, the third preset sequence corresponds to the second preset sequence in which the multiple sub-regions 1112 corresponding to the first detection points 1111 are detected.

For example, the first region 111 includes four sub-regions 1112, and there are twenty first detection points 1111 and four second detection points 1121. Two of the four sub-regions 1112 are in the top portion 113, and the other two of the four sub-regions 1112 are in the bottom portion 114. Each sub-region 1112 has five first detection points 1111 and corresponds to one second detection point 1121 that is for reference. When no gravity Mura appears in the liquid crystal panel 11, there is a standard resistance value at each first detection point 1111, and the standard resistance value is equal to the second resistance value at the corresponding second detection point 1121. The resistance detection unit 12 is configured to obtain four second resistance values Ri by detecting resistance values at the four second detection points 1121 in the third preset sequence, and record the four second resistance values Ri into corresponding coordinates, specifically, (Xm, Yn) Ri=(R1, R2, R3, R4, R5, R6, R7, R8, R9, R10, R11, R12, R13, R14, R15, R16, R17, R18, R19, R20). In addition, the resistance detection unit 12 is configured to obtain twenty first resistance values Ri' by detecting resistance values at the twenty first detection points 1111 in the second preset sequence, and record the twenty first resistance values Ri' to corresponding coordinates, specifically, (Xm, Yn) Ri=(R1', R2', R3', R4', R5', R6', R7', R8', R9', R10', R11', R12', R13', R14', R15', R16', R17', R18', R19', R20'). The resistance difference is expressed as (Xm, Yn) ΔRi=(Ri'−Ri). The color-temperature-compensation unit 13 is configured to determine whether Mura appears in a region at corresponding coordinates according to the resistance difference at each first detection point 1111, and perform color-temperature compensation on the region where Mura appears according to a corresponding resistance difference. The third preset sequence corresponds to the second preset sequence in which the multiple sub-regions 1112 corresponding to the first detection points 1111 are detected.

It is noted that, in the embodiments, there is no limitation on the number and division of the sub-regions, as well as the number and distribution of the first detection points 1111.

Therefore, the resistance detection unit 12 is configured to obtain the resistance values at the multiple first detection points 1111 in the second preset sequence, and obtain the resistance values at the multiple second detection points 1121 in the third preset sequence, so that the color-temperature-compensation unit 13 does not confuse resistance changes corresponding to the multiple first detection points 1111, and thus the color-temperature-compensation unit 13 has an improved compensation on a region where Mura appears in the first region 111.

Refer to FIG. 9 again, in the embodiments, a distance between the second detection point 121 and a sub-region 1112 corresponding to the second detection point 121 is smaller than a distance between the second detection point 121 and each of other sub-regions.

The shorter the distance between the second detection point 1121 and the first detection point 1111, the greater the resistance difference when the same degree of Mura appears. Thus, the second detection point 1121 is set as close as possible to the first detection point 1111. Therefore, for each of the second detection points 1121, the second detection point 1121 is closer to the corresponding sub-region 1112 than other sub-regions 1112, so that the resistance change at the first detection point 1111 in each sub-region 1112 may be detected more easily.

Specifically, four sub-regions 1112 in FIG. 9 are taken for schematic illustration. The first region 111 has a sub-region 1112A, a sub-region 1112B, a sub-region 1112C, and a sub-region 1112D. The multiple second detection points 1121 include a second detection point 1121*a*, a second detection point 1121*b*, a second detection point 1121*c*, and a second detection point 1121*d*. The second detection point 1121*a* is set corresponding to the sub-region 1112A and serves as a reference point of first detection points 1111 in the sub-region 1112A. A distance between the second detection point 1121*a* and the sub-region 1112A is shorter than a distance between the second detection point 1121*a* and each of the sub-region 1112B, the sub-region 1112C, and the sub-region 1112D. The second detection point 1121*b* is set corresponding to the sub-region 1112B and serves as a reference point of first detection points 1111 in the sub-region 1112B. A distance between the second detection point 1121*b* and the sub-region 1112B is shorter than a distance between the second detection point 1121*b* and each of the sub-region 1112A, the sub-region 1112C, and the sub-region 1112D. The second detection point 1121*c* is set corresponding to the sub-region 1112C and serves as a reference point of first detection points 1111 in the sub-region 1112C. A distance between the second detection point 1121*c* and the sub-region 1112C is shorter than a distance between the second detection point 1121*c* and each of the sub-region 1112A, the sub-region 1112B, and the sub-region 1112D. The second detection point 1121*d* is set corresponding to the sub-region 1112D and serves as a reference point of the first detection point 1111 in the sub-region 1112D. A distance between the second detection point 1121*d* and the sub-region 1112D is shorter than a distance between the second detection point 1121*d* and each of the sub-region 1112A, the sub-region 1112B, and the sub-region 1112C.

Figure 10:
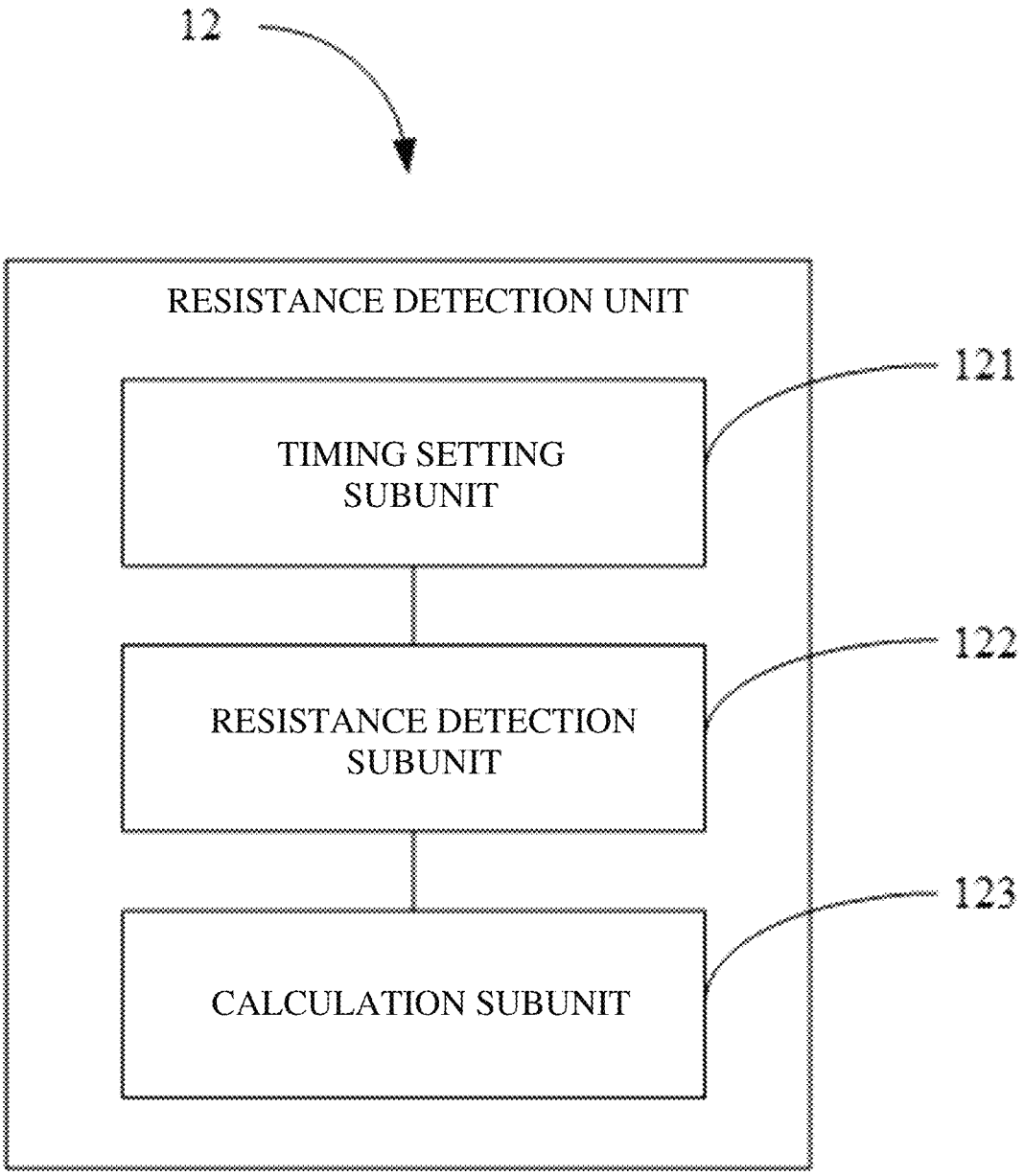
FIG. 10 is a schematic structural diagram of a resistance detection unit in the LCD assembly illustrated in FIG. 3.

Refer to FIG. 10, FIG. 10 is a schematic structural diagram of a resistance detection unit in the LCD assembly illustrated in FIG. 3. In the embodiments, the resistance detection unit 12 includes a timing setting subunit 121, a resistance detection subunit 122, and a calculation subunit 123. The timing setting subunit 121 is configured to set a sequence of detecting the resistance values at the multiple first detection points 1111, and further configured to set a sequence of detecting resistance values at multiple second detection points 1121 when the second region 112 has the multiple second detection points 1121. The resistance detection subunit 122 is electrically connected to the timing setting subunit 121, configured to detect the resistance values at the multiple first detection points 1111 in the sequence set by the timing setting subunit 121, and further configured to detect the resistance values at the multiple second detection points 1121 in the sequence set by the timing setting subunit 121 when the second region has the multiple second detection points 1121. The calculation subunit 123 is electrically connected to the resistance detection subunit 122, configured to receive the first resistance value and the second resistance value, and obtain the resistance difference by calculating the difference between the first resistance value and the second resistance value.

In the embodiments, the timing setting subunit 121 may be configured to set the first preset sequence for detecting the multiple first detection points 1111. The resistance detection subunit 122 is configured to obtain the multiple first resistance values by detecting the resistance values at the multiple first detection points 1111 in the first preset sequence. The calculation subunit 123 is configured to receive the multiple first resistance values and the second resistance value, and obtain multiple resistance differences by calculating the difference between the second resistance value and each of the first resistance values.

In addition, when the second region 112 includes multiple second detection points 1121 and the first region 111 includes multiple sub-regions 1112, the timing setting subunit 121 may be configured to set the second preset sequence for detecting the multiple first detection points 1111 and the third preset sequence for detecting the multiple second detection points 1121. The resistance detection subunit 122 is configured to obtain the multiple first resistance values by detecting the resistance values at the multiple first detection points 1111 in the second preset sequence, and to obtain the multiple second resistance values by detecting the resistance values at the multiple second detection points 1121 in the third preset sequence. The calculation subunit 123 is configured to receive the multiple first resistance values and the multiple second resistance values, and obtain multiple resistance differences by calculating the difference between each second resistance value and the corresponding first resistance value.

Therefore, the timing setting subunit 121 in the resistance detection unit 12 can set a detection sequence, so that the resistance detection subunit 122 can perform resistance detection in the detection sequence set by the timing setting subunit 121, a resistance difference calculated by the calculation subunit 123 may be matched with a corresponding first detection point 1111 through the detection sequence set by the timing setting subunit 121, and thus the color-temperature-compensation unit 13 may perform color-temperature compensation on the first detection point 1111 through the detection sequence set by the timing setting subunit 121.

Figure 11:
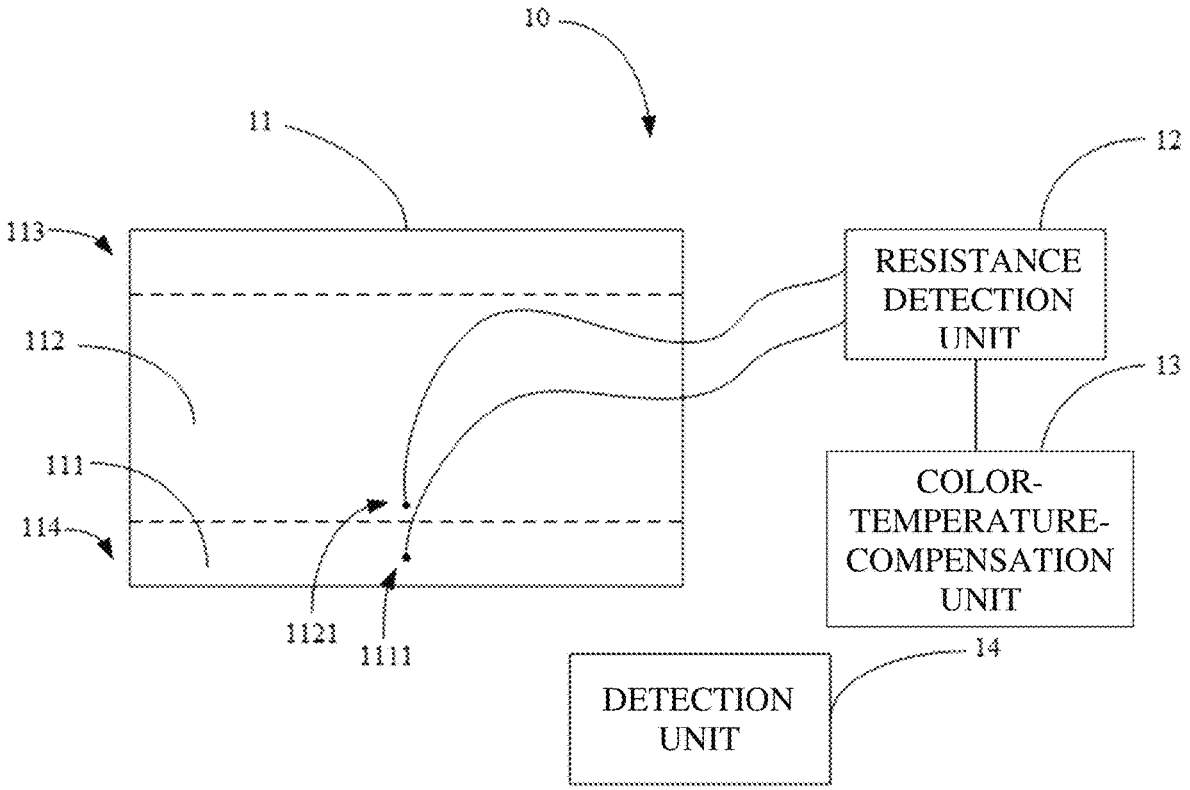
FIG. 11 is a schematic structural diagram of an LCD assembly provided in another embodiment of the disclosure.

Refer to FIG. 11, FIG. 11 is a schematic structural diagram of an LCD assembly provided in another embodiment of the disclosure. In the embodiments, the LCD assembly 10 further includes a detection unit 14. The detection unit 14 is figured to perform, after the color-temperature-compensation unit 13 performs color-temperature compensation on a region where Mura appears in the first region, color-temperature detection on the region subject to the color-temperature compensation in the first region to obtain a color-temperature detection result, and determine whether the color-temperature compensation on the region subject to the color-temperature compensation satisfies a first preset standard according to the color-temperature detection result.

In the embodiments, the detection unit 14 is configured to detect color temperature of the region corresponding to the first detection point 1111 after the color-temperature-compensation unit 13 determines that Mura has appeared in the region corresponding to the first detection point 1111 in the first region 111 according to the resistance difference and performs color-temperature compensation on the region corresponding to the first detection point 1111, and to determine whether the color-temperature compensation on the region corresponding to the first detection point 1111 satisfies the first preset standard. If the color-temperature compensation on the region corresponding to the first detection point 1111 does not satisfy the first preset standard, then the color-temperature-compensation unit 13 performs further color-temperature compensation on the region corresponding to the first detection point 1111 until the color-temperature compensation on the region corresponding to the first detection point 1111 satisfies the first preset standard. In this way, the detection unit 14 may detect the color temperature of the region subjected to the color-temperature compensation in the first region 111, thereby ensuring that the region subjected to the color-temperature compensation in the first region 111 may eventually satisfy the first preset standard, and in turn ensuring the quality of the liquid crystal panel 11. The first preset standard may be, but is not limited to, that a light intensity difference among red light, blue light, and green light is less than 10%, 5%, or 1%. The detection unit 14 may be, but is not limited to, a spectrometer or a spectrophotometer.

Figure 12:
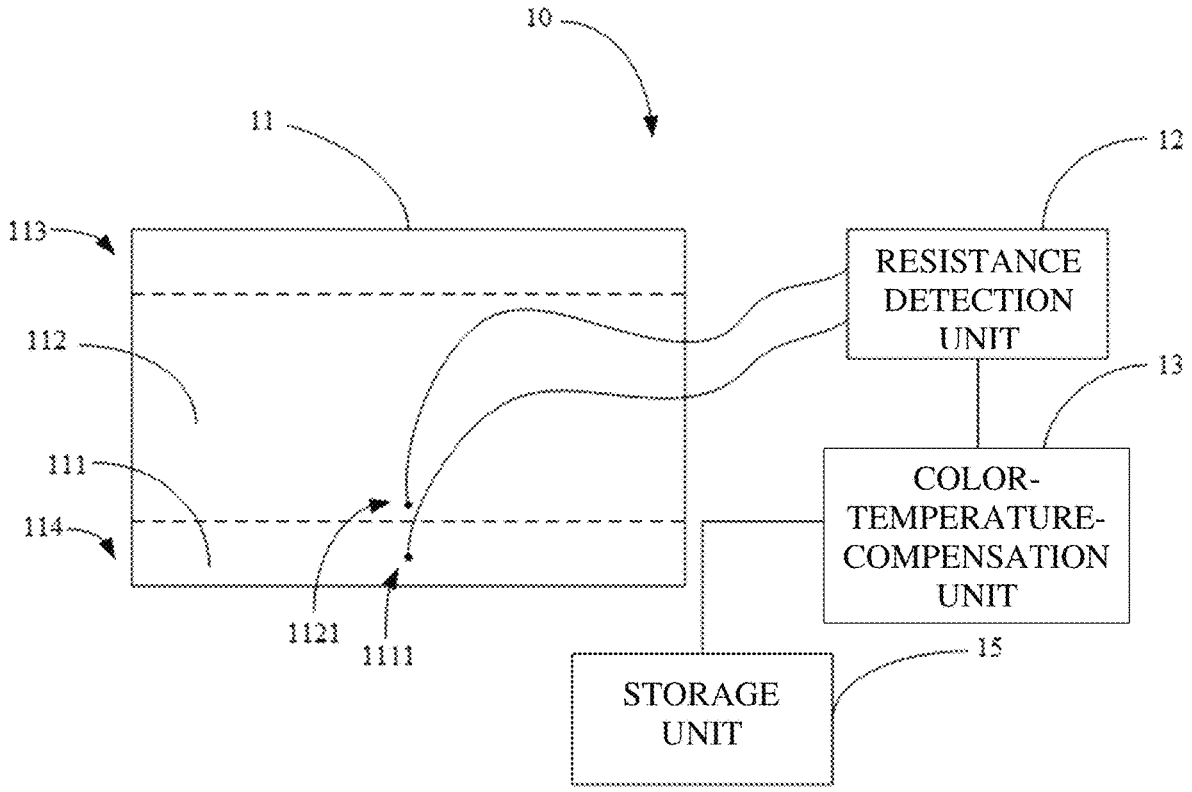
FIG. 12 is a schematic structural diagram of an LCD assembly provided in yet another embodiment of the disclosure.

Refer to FIG. 12, FIG. 12 is a schematic structural diagram of an LCD assembly provided in yet another embodiment of the disclosure. In the embodiments, the LCD assembly 10 further includes a storage unit 15. The storage unit 15 is configured to store multiple color-temperature compensation values satisfying a second preset standard and resistance differences each corresponding to one of the multiple color-temperature compensation values. The color-temperature-compensation unit 13 is configured to compare a current resistance difference with the resistance differences in the storage unit 15, and to perform, when the current resistance difference matches one of the resistance differences in the storage unit 15, color-temperature compensation on the pixels in the region corresponding to the first detection point by using a color-temperature compensation value corresponding to the one of the resistance differences in the storage unit 15 that matches the current resistance difference.

In the embodiments, the storage unit 15 is configured to store multiple color-temperature compensation values satisfying the second preset standard and resistance differences each corresponding to one of multiple color-temperature compensation values. The second preset standard may be, but is not limited to, that the light intensity difference among red light, blue light, and green light is less than 10%, 5%, or 1%.

After the color-temperature-compensation unit 13 receives the resistance difference from the resistance detection unit 12, the resistance difference received from the resistance detection unit 12 is compared with the resistance differences in the storage unit 15. The color-temperature-compensation unit 13 is configured to perform color-temperature compensation on the pixels in the region corresponding to the first detection point 1111 by using a color-temperature compensation value in the storage unit 15 corresponding to the resistance difference received from the resistance detection unit 12, when the resistance difference received from the resistance detection unit 12 matches one of the resistance differences in the storage unit 15. As such, the region corresponding to the first detection point 1111 may satisfy the second preset standard after the color-temperature compensation, thereby improving the quality of the liquid crystal panel 11 and improving the efficiency of the color-temperature compensation. The resistance difference received from the resistance detection unit 12 matches one of the resistance differences in the storage unit 15, which means that a difference between the resistance difference received from the resistance detection unit 12 and one of the resistance differences in the storage unit 15 is less than 10%, 5%, or 1%.

Refer to FIG. 3 and FIG. 4 again, in the embodiments, the color-temperature-compensation unit 13 is configured to perform, with a same compensation value, color-temperature compensation on all pixels in a region with the first detection point 1111 as a center.

In this embodiment, the region with the first detection point 1111 as the center may be, but is not limited to, a rectangular region or a circular region. For example, the region with the first detection point 1111 as the center may be a 1×5 pixel region, a 2×7 pixel region, or a 9×9 pixel region with the first detection point 1111 as the center.

The color-temperature-compensation unit 13 is configured to perform color-temperature compensation on all pixels in the region with the first detection point 1111 as the center with the same compensation value, so that efficiency of color-temperature compensation on all pixels in the region with the first detection point 1111 as the center can be improved.

In addition, in other embodiments, relative color-temperature compensation may also be performed according to a degree of Mura appeared in each pixel in the region with the first detection point 1111 as the center, so that the effect of color-temperature compensation on the region with the first detection point 1111 as the center may be improved.

Specific embodiments of performing color-temperature compensation on pixels in the region corresponding to the first detection point 1111 are described hereinafter.

The pixels include a blue sub-pixel, a green sub-pixel, and a red sub-pixel. The color-temperature-compensation unit 13 is configured to perform color-temperature compensation on the pixels in the region corresponding to the first detection point 1111 according to the resistance difference as follows.

In an embodiment, the color-temperature-compensation unit 13 is configured to increase a brightness of the blue sub-pixel in a region corresponding to the first detection point 1111 where Mura appears, and maintain a brightness of the green sub-pixel and a brightness of the red sub-pixel in the region corresponding to the first detection point 1111 where Mura appears. Specifically, a value of a compensation on the region corresponding to the first detection point 1111 where Mura appears may be expressed as ΔColour=(X, Y) ΔR*(Tcon ACC (ΔB)), where (X, Y) ΔR represents a resistance difference corresponding to the first detection point 1111, Tcon ACC (ΔB) represents increasing the brightness of the blue sub-pixel in the region corresponding to the first detection point 1111 where Mura appears by the color-temperature-compensation unit 13.

In another embodiment, the color-temperature-compensation unit 13 is configured to reduce the brightness of the green sub-pixel and the brightness of the red sub-pixel in the region corresponding to the first detection point 1111 where Mura appears, and maintain the brightness of the blue sub-pixel in the region corresponding to the first detection point 1111 where Mura appears. Specifically, a value of a compensation on the region corresponding to the first detection point 1111 where Mura appears may be expressed as ΔColour=(X, Y) ΔR*(Tcon ACC (ΔR+ΔG)), where (X, Y) ΔR represents a resistance difference corresponding to the first detection point 1111, Tcon ACC (ΔR+ΔG) represents decreasing the brightness of the green sub-pixel and the brightness of the red sub-pixel in the region corresponding to the first detection point 1111 where Mura appears by the color-temperature-compensation unit 13.

In yet another embodiment, the color-temperature-compensation unit 13 is configured to increase the brightness of the blue sub-pixel in the region corresponding to the first detection point 1111 where Mura appears, and reduce the brightness of the green sub-pixel and the brightness of the red sub-pixel in the region corresponding to the first detection point 1111 where Mura appears. Specifically, a value of a compensation on the region corresponding to the first detection point 1111 where Mura appears may be expressed as ΔColour=(X, Y) ΔR*(Tcon ACC (ΔR+ΔG+ΔB)), where (X, Y) ΔR represents a resistance difference corresponding to the first detection point 1111, Tcon ACC (ΔR+ΔG+ΔB) represents reducing the brightness of the green sub-pixel and the brightness of the red sub-pixel in the region corresponding to the first detection point 1111 where Mura appears and increasing the brightness of the blue sub-pixel in the region corresponding to the first detection point 1111 where Mura appears by the color-temperature-compensation unit 13.

It is noted that the green light has a greater effect on brightness than the red light and the blue light. Thus, the brightness of the green sub-pixel and the brightness of the red sub-pixel in the region corresponding to first detection point 1111 where Mura appears are kept unchanged as much as possible, while the brightness of the blue sub-pixel in the region corresponding to the first detection point 1111 where Mura appears is improved by the color-temperature-compensation unit 13, so that the color-temperature compensation on the pixels in the region corresponding to the first detection point 1111 can be achieved.

In addition, if the brightness of the region corresponding to the first detection point 1111 is significantly greater than brightness of other regions in the liquid crystal panel 11, the green sub-pixel in the region corresponding to the first detection point 1111 can be reduced by the color-temperature-compensation unit 13, so that the brightness of the region corresponding to the first detection point 1111 can be equivalent to the brightness of other regions in the liquid crystal panel 11.

In addition, if the brightness of the region corresponding to the first detection point 1111 where Mura appears is significantly lower than the brightness of other regions in the liquid crystal panel 11 after color-temperature compensation, a brightness of a green sub-pixel in other regions in the first detection point 1111 may be reduced by the color-temperature-compensation unit 13, so that overall brightness of the liquid crystal panel 11 can be uniform.

Figure 13:
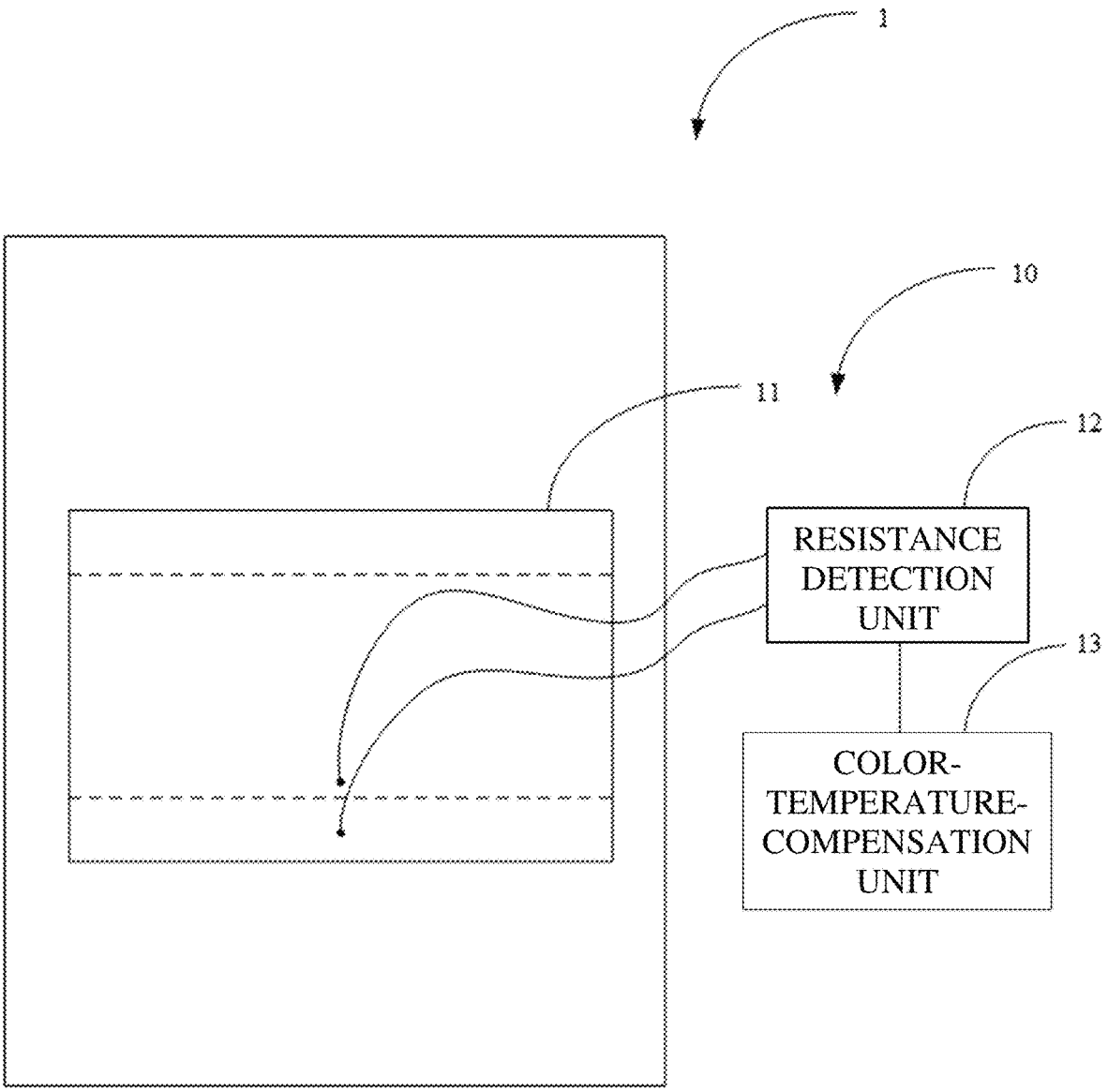
FIG. 13 is a schematic structural diagram of an electronic device provided in an embodiment of the disclosure.

Refer to FIG. 13, FIG. 13 is a schematic structural diagram of an electronic device provided in an embodiment of the disclosure. In the embodiments, the electronic device 1 includes the LCD assembly 10 described in any one of the above embodiments.

In the embodiments, the electronic device 1 may be, but is not limited to, a mobile phone, a computer, or a television. The electronic device 1 is configured to display through the liquid crystal panel 11 in the LCD assembly 10.

During normal use of the electronic device 1, the resistance detection unit 12 and the color-temperature-compensation unit 13 do not operate, and only the liquid crystal panel 11 operates. When the electronic device 1 needs to be overhauled, the resistance detection unit 12 and the color-temperature-compensation unit 13 operate, the resistance detection unit 12 detects the first detection point 1111 in the first region 111, and the color-temperature-compensation unit 13 performs color-temperature compensation on the region corresponding to the first detection point 1111 when Mura appears at the first detection point 1111 in the first region 111, so that a display quality of the liquid crystal panel 11 can be improved, and thus a display quality of the electronic device 1 is improved. In addition, regular maintenance of the electronic device 1 can be achieved by regular detection.

Although the embodiments of the disclosure have been illustrated and described above, it can be understood that the above embodiments are exemplary and cannot be understood as limitations on the disclosure. Those skilled in the art can make changes, modifications, replacements, and variations for the above embodiments within the scope of the disclosure, and these improvements and modifications are also considered to fall into the protection scope of the disclosure.

What is claimed is:

1. A Liquid Crystal Display (LCD) assembly comprising a liquid crystal panel, wherein the liquid crystal panel has a first region and a second region, the first region is located at least one of a top portion or a bottom portion of the liquid crystal panel, the second region is closer to a center of the liquid crystal panel than the first region, the liquid crystal panel has a first detection point in the first region and a second detection point in the second region, and the LCD assembly further comprises:

a resistance detection unit configured to obtain a first resistance value by detecting a resistance value at the first detection point and obtain a second resistance value by detecting a resistance value at the second detection point, and further configured to obtain a resistance difference by calculating a difference between the second resistance value and the first resistance value; and a color-temperature-compensation unit electrically connected to the resistance detection unit, configured to receive the resistance difference, determine whether Mura appears in a region corresponding to the first detection point in the first region according to the resistance difference, and perform color-temperature compensation on pixels in the region corresponding to the first detection point according to the resistance difference when Mura appears in the region corresponding to the first detection point;

wherein the pixels comprise a blue sub-pixel, a green sub-pixel, and a red sub-pixel, the color-temperature-compensation unit being configured to perform the color-temperature compensation on the pixels in the region corresponding to the first detection point according to the resistance difference comprises at least one of:

the color-temperature-compensation unit being configured to increase a brightness of the blue sub-pixel in a region corresponding to the first detection point where Mura appears, and maintain a brightness of the green sub-pixel and a brightness of the red sub-pixel in the region corresponding to the first detection point where Mura appears;

the color-temperature-compensation unit being configured to reduce the brightness of the green sub-pixel and the brightness of the red sub-pixel in the region corresponding to the first detection point where Mura appears, and maintain the brightness of the blue sub-pixel in the region corresponding to the first detection point where Mura appears; or the color-temperature-compensation unit being configured to increase the brightness of the blue sub-pixel in the region corresponding to the first detection point where Mura appears, and reduce the brightness of the green sub-pixel and the brightness of the red sub-pixel in the region corresponding to the first detection point where Mura appears.

2. The LCD assembly of claim 1, wherein the liquid crystal panel has a plurality of first detection points in the first region and one second detection point in the second region;

the resistance detection unit is configured to obtain a plurality of first resistance values by detecting resistance values at the plurality of first detection points in a first preset sequence, and further configured to obtain a plurality of resistance differences by calculating a difference between the second resistance value and each of the plurality of first resistance values; and the color-temperature-compensation unit is configured to receive the plurality of resistance differences, determine whether Mura appears in a region corresponding to each of the plurality of first detection points in the first region according to the plurality of resistance differences, and perform color-temperature compensation on pixels in each region where Mura appears according to the plurality of resistance differences.

3. The LCD assembly of claim 2, wherein the resistance detection unit comprises:

a timing setting subunit configured to set a sequence of detecting the resistance values at the plurality of first detection points, and further configured to set a sequence of detecting resistance values at a plurality of second detection points when the second region has the plurality of second detection points;

a resistance detection subunit electrically connected to the timing setting subunit, configured to detect the resistance values at the plurality of first detection points in the sequence set by the timing setting subunit, and further configured to detect the resistance values at the plurality of second detection points in the sequence set by the timing setting subunit when the second region has the plurality of second detection points; and a calculation subunit electrically connected to the resistance detection subunit, configured to receive the first resistance value and the second resistance value, and obtain the resistance difference by calculating the difference between the first resistance value and the second resistance value.

4. The LCD assembly of claim 1, wherein the first region comprises a plurality of sub-regions, wherein each of the plurality of sub-regions comprises a plurality of first detection points, the second region comprises a plurality of second detection points, and each of the plurality of second detection points corresponds to one of the plurality of sub-regions;

the resistance detection unit is configured to obtain a plurality of first resistance values by detecting resistance values at the plurality of first detection points in a second preset sequence;

the resistance detection unit is configured to obtain a plurality of second resistance values by detecting resistance values at the plurality of second detection points in a third preset sequence, and obtain a plurality of sub-resistance differences by calculating a difference between each second resistance value and each of the first sub-resistance values obtained by detecting resistance values at the first detection points in a corresponding sub-region; and the color-temperature-compensation unit is configured to receive the plurality of sub-resistance differences, determine whether Mura appears in a region corresponding to each of the plurality of first detection points in the first region according to the plurality of sub-resistance differences, and perform color-temperature compensation on pixels in each region where Mura appears according to the plurality of sub-resistance differences.

5. The LCD assembly of claim 4, wherein a distance between the second detection point and a sub-region corresponding to the second detection point is smaller than a distance between the second detection point and each of other sub-regions.

6. The LCD assembly of claim 1, further comprising:

a detection unit configured to perform, after the color-temperature-compensation unit performs color-temperature compensation on a region where Mura appears in the first region, color-temperature detection on the region subject to the color-temperature compensation in the first region, and determine whether the color-temperature compensation on the region subject to the color-temperature compensation satisfies a first preset standard according to the color-temperature detection result.

7. The LCD assembly of claim 1, further comprising a storage unit, wherein the storage unit is configured to store a plurality of color-temperature compensation values satisfying a second preset standard and resistance differences each corresponding to one of the plurality of color-temperature compensation values; and the color-temperature-compensation unit is configured to compare a current resistance difference with the resistance differences in the storage unit, and to perform, when the current resistance difference matches one of the resistance differences in the storage unit, color-temperature compensation on the pixels in the region corresponding to the first detection point by using a color-temperature compensation value corresponding to the one of the resistance differences in the storage unit that matches the current resistance difference.

8. The LCD assembly of claim 1, wherein the color-temperature-compensation unit is configured to perform, with a same compensation value, color-temperature compensation on all pixels in a region with the first detection point as a center.

9. An electronic device, comprising a Liquid Crystal Display (LCD) assembly, the LCD assembly comprising a liquid crystal panel, wherein the liquid crystal panel has a first region and a second region, the first region is located at least one of a top portion or a bottom portion of the liquid crystal panel, the second region is closer to a center of the liquid crystal panel than the first region, the liquid crystal panel has a first detection point in the first region and a second detection point in the second region, and the LCD assembly further comprises:

a resistance detection unit configured to obtain a first resistance value by detecting a resistance value at the first detection point and obtain a second resistance value by detecting a resistance value at the second detection point, and further configured to obtain a resistance difference by calculating a difference between the second resistance value and the first resistance value; and a color-temperature-compensation unit electrically connected to the resistance detection unit, configured to receive the resistance difference, determine whether Mura appears in a region corresponding to the first detection point in the first region according to the resistance difference, and perform color-temperature compensation on pixels in the region corresponding to the first detection point according to the resistance difference when Mura appears in the region corresponding to the first detection point;

wherein the pixels comprise a blue sub-pixel, a green sub-pixel, and a red sub-pixel, the color-temperature-compensation unit being configured to perform the color-temperature compensation on the pixels in the region corresponding to the first detection point according to the resistance difference comprises at least one of:

the color-temperature-compensation unit being configured to increase a brightness of the blue sub-pixel in a region corresponding to the first detection point where Mura appears, and maintain a brightness of the green sub-pixel and a brightness of the red sub-pixel in the region corresponding to the first detection point where Mura appears;

the color-temperature-compensation unit being configured to reduce the brightness of the green sub-pixel and the brightness of the red sub-pixel in the region corresponding to the first detection point where Mura appears, and maintain the brightness of the blue sub-pixel in the region corresponding to the first detection point where Mura appears; or the color-temperature-compensation unit being configured to increase the brightness of the blue sub-pixel in the region corresponding to the first detection point where Mura appears, and reduce the brightness of the green sub-pixel and the brightness of the red sub-pixel in the region corresponding to the first detection point where Mura appears.

10. The electronic device of claim 9, wherein the liquid crystal panel has a plurality of first detection points in the first region and one second detection point in the second region;

the resistance detection unit is configured to obtain a plurality of first resistance values by detecting resistance values at the plurality of first detection points in a first preset sequence, and further configured to obtain a plurality of resistance differences by calculating a difference between the second resistance value and each of the plurality of first resistance values; and the color-temperature-compensation unit is configured to receive the plurality of resistance differences, determine whether Mura appears in a region corresponding to each of the plurality of first detection points in the first region according to the plurality of resistance differences, and perform color-temperature compensation on pixels in each region where Mura appears according to the plurality of resistance differences.

11. The electronic device of claim 9, wherein the first region comprises a plurality of sub-regions, wherein each of the plurality of sub-regions comprises a plurality of first detection points, the second region comprises a plurality of second detection points, and each of the plurality of second detection points corresponds to one of the plurality of sub-regions;

the resistance detection unit is configured to obtain a plurality of first resistance values by detecting resistance values at the plurality of first detection points in a second preset sequence;

the resistance detection unit is configured to obtain a plurality of second resistance values by detecting resistance values at the plurality of second detection points in a third preset sequence, and obtain a plurality of sub-resistance differences by calculating a difference between each second resistance value and each of the first sub-resistance values obtained by detecting resistance values at the first detection points in a corresponding sub-region; and the color-temperature-compensation unit is configured to receive the plurality of sub-resistance differences, determine whether Mura appears in a region corresponding to each of the plurality of first detection points in the first region according to the plurality of sub-resistance differences, and perform color-temperature compensation on pixels in each region where Mura appears according to the plurality of sub-resistance differences.

12. The electronic device of claim 11, wherein a distance between the second detection point and a sub-region corresponding to the second detection point is smaller than a distance between the second detection point and each of other sub-regions.

13. The electronic device of claim 9, further comprising:

a detection unit configured to perform, after the color-temperature-compensation unit performs color-temperature compensation on a region where Mura appears in the first region, color-temperature detection on the region subject to the color-temperature compensation in the first region, and determine whether the color-temperature compensation on the region subject to the color-temperature compensation satisfies a first preset standard according to the color-temperature detection result.

14. The electronic device of claim 9, further comprising a storage unit, wherein the storage unit is configured to store a plurality of color-temperature compensation values satisfying a second preset standard and resistance differences each corresponding to one of the plurality of color-temperature compensation values; and the color-temperature-compensation unit is configured to compare a current resistance difference with the resistance differences in the storage unit, and to perform, when the current resistance difference matches one of the resistance differences in the storage unit, color-temperature compensation on the pixels in the region corresponding to the first detection point by using a color-temperature compensation value corresponding to the one of the resistance differences in the storage unit that matches the current resistance difference.

15. The electronic device of claim 9, wherein the color-temperature-compensation unit is configured to perform, with a same compensation value, color-temperature compensation on all pixels in a region with the first detection point as a center.

* * * * *